US011697299B2

(12) United States Patent
Imakura et al.

(10) Patent No.: US 11,697,299 B2
(45) Date of Patent: Jul. 11, 2023

(54) THERMAL TRANSFER SHEET, COMBINATION OF THERMAL TRANSFER SHEET AND INTERMEDIATE TRANSFER MEDIUM, METHOD FOR PRODUCING PRINT, AND THERMAL TRANSFER PRINTER

(71) Applicant: Dai Nippon Printing Co., Ltd., Tokyo (JP)

(72) Inventors: Yoshihiro Imakura, Tokyo (JP); Koichiro Kuroda, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 421 days.

(21) Appl. No.: 16/765,267

(22) PCT Filed: Jan. 31, 2019

(86) PCT No.: PCT/JP2019/003318
§ 371 (c)(1),
(2) Date: May 19, 2020

(87) PCT Pub. No.: WO2019/151378
PCT Pub. Date: Aug. 8, 2019

(65) Prior Publication Data

US 2020/0369063 A1 Nov. 26, 2020

(30) Foreign Application Priority Data

Jan. 31, 2018 (JP) ..... 2018-015585

(51) Int. Cl.
*B41M 5/382* (2006.01)
*B41M 5/40* (2006.01)
(Continued)

(52) U.S. Cl.
CPC ..... *B41M 5/38257* (2013.01); *B41M 5/405* (2013.01); *B41M 5/423* (2013.01);
(Continued)

(58) Field of Classification Search
CPC .. B41M 5/38257; B41M 5/405; B41M 5/423; B41M 5/44; B41M 5/443;
(Continued)

(56) References Cited

U.S. PATENT DOCUMENTS 5,776,595 A 7/1998 Kurokawa et al.
6,210,794 B1 * 4/2001 Nakamura ..... B41M 5/345 428/32.79

(Continued)

FOREIGN PATENT DOCUMENTS

JP H07-290848 A 11/1995
JP 2002-254834 A1 9/2002

(Continued)

OTHER PUBLICATIONS

Extended European Search Report (Application No. 19747004.0) dated Jul. 22, 2021.

(Continued)

*Primary Examiner* — Gerard Higgins
(74) *Attorney, Agent, or Firm* — Burr Patent Law, PLLC

(57) ABSTRACT

Provided are a combination of a thermal transfer sheet and an intermediate transfer medium which is capable of accurately transferring only a transfer layer of the intermediate transfer medium desired to be transferred onto a transfer receiving article in the production of a print, and a thermal transfer sheet which is used in combination with an intermediate transfer medium. Also provided are a method for producing a print, comprising accurately transferring only a transfer layer of an intermediate transfer medium desired to be transferred onto a transfer receiving article, and a thermal (Continued)

transfer printer which is used in this method for producing a print. In the thermal transfer sheet which is used in combination with an intermediate transfer medium, inhibit layer 2 is disposed on substrate 1, and the inhibit layer 2 contains a carnauba wax.

8 Claims, 5 Drawing Sheets

(51) Int. Cl.
*B41M 5/44* (2006.01)
*B41M 5/42* (2006.01)

(52) U.S. Cl.
CPC ..... *B41M 5/44* (2013.01); *B41M 5/443* (2013.01); *B41M 2205/10* (2013.01); *B41M 2205/30* (2013.01); *B41M 2205/38* (2013.01)

(58) Field of Classification Search
CPC ..... B41M 2205/02; B41M 2205/10; B41M 2205/30; B41M 2205/38
See application file for complete search history.

(56) References Cited

U.S. PATENT DOCUMENTS

| | | | |
|---|---|---|---|
| 2002/0195005 | A1 | 12/2002 | Oshima et al. |
| 2015/0239273 | A1 | 8/2015 | Sakamoto et al. |

FOREIGN PATENT DOCUMENTS

| | | | |
|---|---|---|---|
| JP | 2002-254839 | A1 | 9/2002 |
| JP | 2002-293044 | A1 | 10/2002 |
| JP | 2014-080016 | A1 | 5/2014 |

OTHER PUBLICATIONS

Japanese Patent Publication No. 2002-293044 A1 (Ref. AE) correspond to U.S. Patent Application No. 2002/0195005 A1 (Ref. AA).
Japanese Patent Publication No. 2014-080016 A1 (Ref. AF) is discussed at paragraph [0002] of the present specification and corresponds to U.S. Patent Application Publication No. 2015/0239273 A1 (Ref. AB).
International Search Report and Written Opinion (Application No. PCT/JP2019/003318) dated May 7, 2019.

* cited by examiner

THERMAL TRANSFER SHEET, COMBINATION OF THERMAL TRANSFER SHEET AND INTERMEDIATE TRANSFER MEDIUM, METHOD FOR PRODUCING PRINT, AND THERMAL TRANSFER PRINTER

TECHNICAL FIELD

The present invention relates to a thermal transfer sheet, a combination of a thermal transfer sheet and an intermediate transfer medium, a method for producing a print, and a thermal transfer printer.

BACKGROUND ART

As proposed in Patent Literature 1, an intermediate transfer medium in which a transfer layer comprising a receiving layer (hereinafter, also referred to as a transfer layer) is peelably disposed on a substrate is used as a device for forming a print without concern for constraints about the kind of transfer receiving article. According to this intermediate transfer medium, a print with a thermal transfer image formed on a transfer receiving article can be obtained by using a thermal transfer sheet having a colorant layer, forming a thermal transfer image on the receiving layer of the intermediate transfer medium, and then transferring the transfer layer comprising this receiving layer onto an arbitrary transfer receiving article. Particularly, the intermediate transfer medium is preferably used for, for example, transfer receiving articles that do not allow easy colorant transference and thus fail to form a high-quality image directly thereon, or transfer receiving articles that are likely to cause fused adherence with a colorant layer when undergoing the thermal transfer.

Incidentally, depending on the type of a print obtained by transferring a transfer layer of an intermediate transfer medium onto a transfer receiving article, it may be necessary to leave a certain region untreated, for example, regions allocated for an IC chip, a magnetic strip, a transmitting and receiving antenna unit, a signature portion and the like. Thus, on the surface of the transfer receiving article, in some cases, there is a region that is inconvenient when covered with the transfer layer. In other words, it may be necessary to expose the surface of the transfer receiving article. Thus, the transfer layer of the intermediate transfer medium is required to have a function of being able to accurately transfer only the transfer layer desired to be transferred onto a transfer receiving article. However, under these circumstances, mere studies on the transfer layer of the intermediate transfer medium cannot achieve the requirements described above.

CITATION LIST

Patent Literature

Patent Literature 1: Japanese Patent Laid-Open No. 2014-80016

SUMMARY OF INVENTION

Technical Problem

The present invention has been made in light of such circumstances. A major object of the present invention is to provide a combination of a thermal transfer sheet and an intermediate transfer medium which is capable of accurately transferring only a transfer layer of the intermediate transfer medium desired to be transferred onto a transfer receiving article in the production of a print, and a thermal transfer sheet which is used in combination with an intermediate transfer medium, and to provide a method for producing a print, comprising accurately transferring only a transfer layer of an intermediate transfer medium desired to be transferred onto a transfer receiving article, and a thermal transfer printer which is used in this production method.

Solution to Problem

In order to attain the object described above, the thermal transfer sheet according to an embodiment of the present disclosure is a thermal transfer sheet which is used in combination with an intermediate transfer medium, wherein an inhibit layer is disposed on a substrate so as to be peelable from the substrate, wherein the inhibit layer is transferred onto the intermediate transfer medium, and the inhibit layer contains a carnauba wax.

In the thermal transfer sheet described above, the inhibit layer may further contain a polyethylene wax and a thermoplastic elastomer.

In order to attain the object described above, the thermal transfer sheet according to an embodiment of the present disclosure is a thermal transfer sheet which is used in combination with an intermediate transfer medium, wherein an inhibit layer is disposed on a substrate so as to be peelable from the substrate, wherein the inhibit layer is transferred onto the intermediate transfer medium, and the inhibit layer contains at least one member selected from the group consisting of a cured product of an active ray-curable resin, a cured product of a silicone resin, and a cured product of a thermoplastic resin.

In each thermal transfer sheet described above, any one of a dye layer and a heat-seal layer, or both, and the inhibit layer may be disposed as being frame sequentially on the same surface of the substrate. Also, the dye layer, the inhibit layer, and the heat-seal layer may be disposed as being frame sequentially on the same surface of the substrate. Alternatively, the dye layer, the heat-seal layer, and the inhibit layer may be disposed as being frame sequentially on the same surface of the substrate.

In order to attain the object described above, the combination of a thermal transfer sheet and an intermediate transfer medium according to an embodiment of the present disclosure is a combination wherein the thermal transfer sheet used is the thermal transfer sheet according to each of the embodiments described above, and the intermediate transfer medium is an intermediate transfer medium in which a transfer layer is disposed on a support, the transfer layer having a single-layer configuration consisting of a receiving layer, or having a layered configuration where a receiving layer is positioned furthest from the support.

The intermediate transfer medium used in the combination described above may be an intermediate transfer medium in which a release layer is disposed between the support and the transfer layer, wherein the release layer contains silsesquioxane. The release layer of the intermediate transfer medium used in the combination described above may further contain urethane-modified polyester having a glass transition temperature (Tg) of 50° C. or lower.

The transfer layer of the intermediate transfer medium used in the combination described above may assume a layered structure where a protective layer and the receiving layer are layered in the presented order from the support side, wherein the protective layer contains a cured product of an active ray-curable resin.

In order to attain the object described above, the method for producing a print according to an embodiment of the present disclosure is a method for producing a print using the combination of a thermal transfer sheet and an intermediate transfer medium according to each of the embodiments described above, the method comprising: the step of forming a thermal transfer image on the transfer layer of the intermediate transfer medium; a first transfer step of transferring the inhibit layer of the thermal transfer sheet onto a part of the transfer layer with the thermal transfer image formed thereon; and a second transfer step of transferring the transfer layer of the intermediate transfer medium onto a transfer receiving article, wherein the second transfer step is the step of using the inhibit layer transferred onto a part of the transfer layer as a masking member, and transferring the transfer layer having no overlap with the inhibit layer onto the transfer receiving article.

In order to attain the object described above, the thermal transfer printer according to an embodiment of the present disclosure is a thermal transfer printer which is used in the method for producing a print, and has an energy application device.

Advantageous Effects of Invention

According to the combination of a thermal transfer sheet and an intermediate transfer medium of the present invention or the thermal transfer sheet of the present invention which is used in combination with an intermediate transfer medium, such a combination is capable of accurately transferring only a transfer layer of the intermediate transfer medium desired to be transferred onto a transfer receiving article in the production of a print. According to the method for producing a print or the thermal transfer printer of the present invention, a print can be produced by accurately transferring only a transfer layer of an intermediate transfer medium desired to be transferred onto a transfer receiving article.

BRIEF DESCRIPTION OF DRAWINGS

Both

Figure 10A:
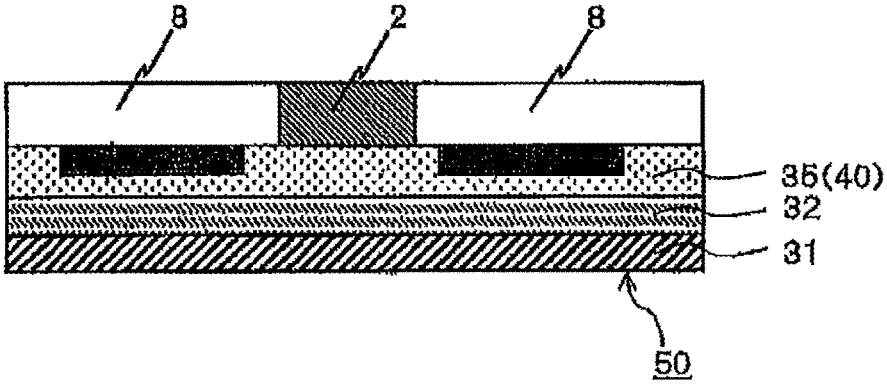
Figure 10B:
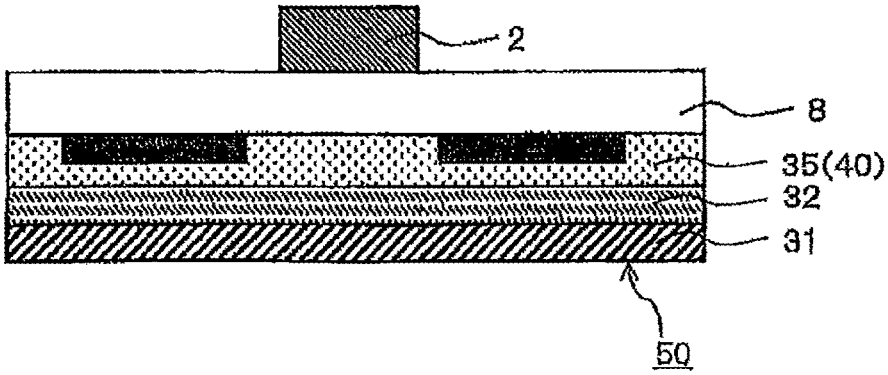

Each of FIGS. 10A and 10B is a schematic plane view of an intermediate transfer medium showing one example of a transfer region of a heat-seal layer.

Figure 11A:
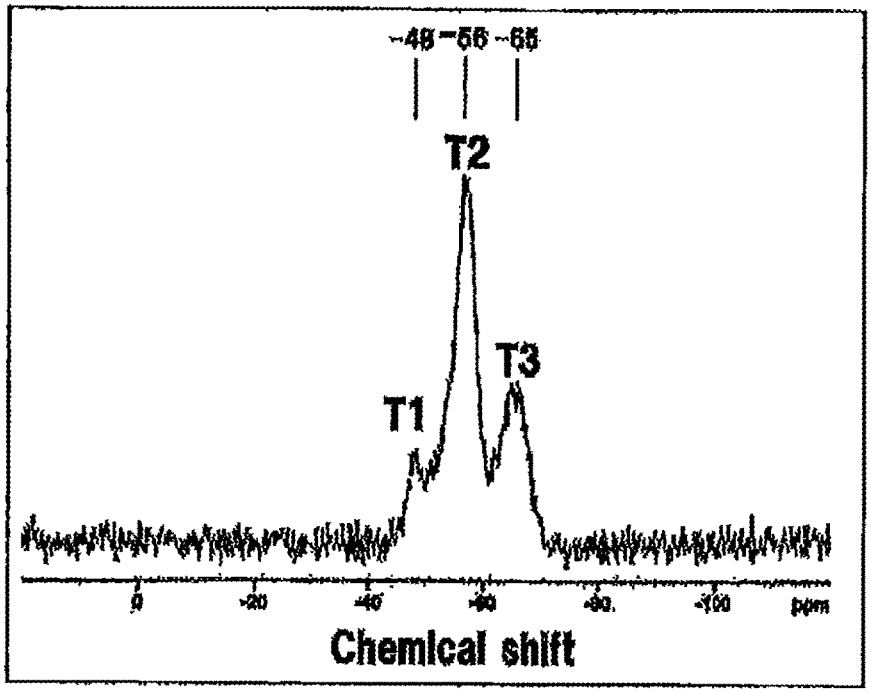
Figure 11B:
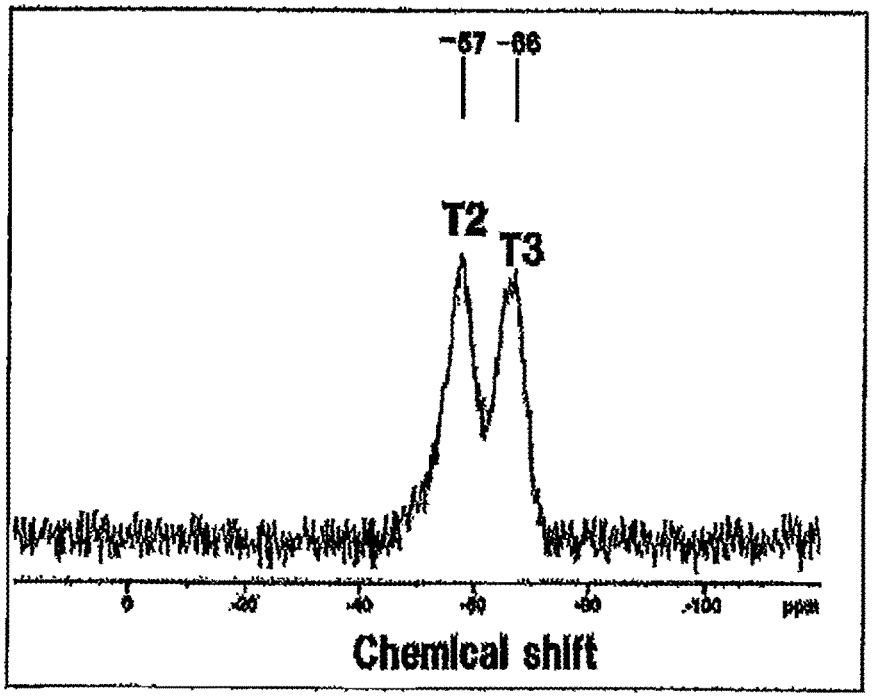

Each of FIGS. 11A and 11B is one example of $^{29}$Si NMR measurement results about a release layer containing silsesquioxane.

DESCRIPTION OF EMBODIMENTS

Hereinafter, embodiments of the present invention will be described with reference to the drawings, etc. The present invention can be carried out in many different modes and should not be interpreted by limiting the present invention to the contents described in the embodiments illustrated below. The drawings may schematically show the width, thickness, etc. of each part as compared to actual forms for clearer explanation. This merely gives one example and does not limit the interpretation of the present invention. In the specification of the present application and each drawing, the same reference numerals and symbols will be used to designate the same or similar factors as those mentioned above in the preceding drawing, so that the description will be omitted.

<<Thermal Transfer Sheet>>

Figure 1:
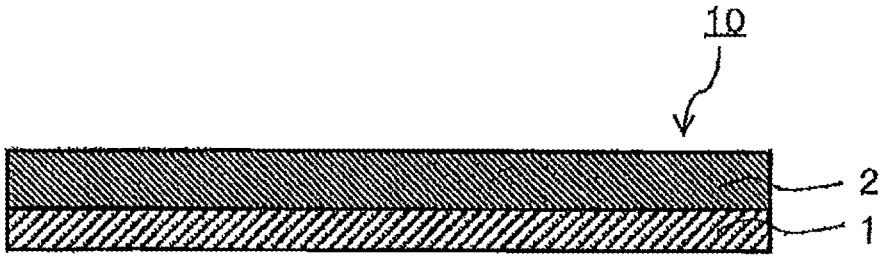
FIG. 1 is a schematic cross-sectional view of the thermal transfer sheet of one embodiment.

Thermal transfer sheet 10 according to an embodiment of the present disclosure (hereinafter, referred to as the thermal transfer sheet of one embodiment) assume a configuration, as shown in FIG. 1, in which inhibit layer 2 is disposed on one surface of substrate 1. The inhibit layer 2 is disposed so as to be peelable from the substrate 1, and is a layer that is transferred onto transfer layer 40 of intermediate transfer medium 50 mentioned later (see FIG. 8B). In other words, the inhibit layer 2 is a layer that is transferred onto receiving layer 35 positioned on the outermost surface of the intermediate transfer medium 50. The phrase "peelable from the substrate 1" as to the inhibit layer 2 means that a surface positioned on the substrate 1 side of the inhibit layer 2 is a peeling interface, and means that, for example, in the case of establishing an arbitrary release layer on the substrate 1 and establishing the inhibit layer 2 on this release layer, the inhibit layer 2 is peelable from the release layer.

The thermal transfer sheet 10 of one embodiment will be specifically described. Referring to FIG. 8, a method for producing a print using the thermal transfer sheet of one embodiment will be described. FIG. 8 is an operation flow chart showing one example of the method for producing a print using the thermal transfer sheet of one embodiment. A specific example of the method for producing a print will be mentioned later.

Figure 8A:
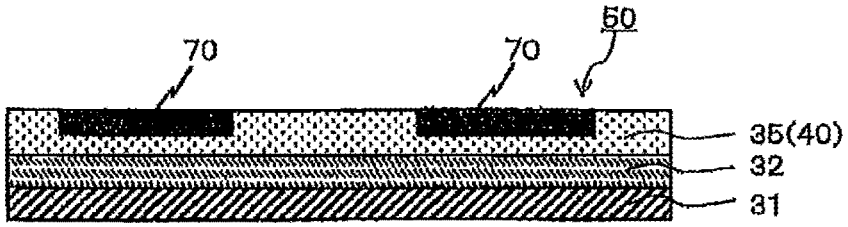
FIG. 8 is a schematic operation flow chart showing one example of the method for producing a print of one embodiment.
Figure 8B:
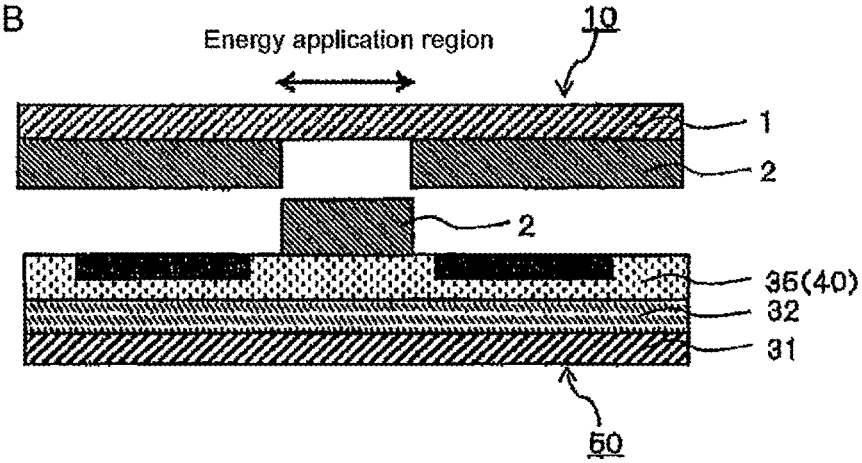

In the method for producing a print using the thermal transfer sheet 10 of one embodiment, as shown in FIG. 8B, intermediate transfer medium 50 is superposed on the thermal transfer sheet 10 of one embodiment. Energy is applied to the back face side of the thermal transfer sheet 10 (in the form shown in FIG. 8B, the upper face of the thermal transfer sheet 10), for example, with a heating member such as a thermal head (not shown). Inhibit layer 2 of the thermal transfer sheet 10 corresponding to a region to which energy has been applied (see the energy application region of FIG. 8B) is transferred onto transfer layer 40 of the intermediate transfer medium 50. In other words, the inhibit layer 2 is transferred onto receiving layer 35 positioned on the outermost surface of the transfer layer 40.

Figure 8C:
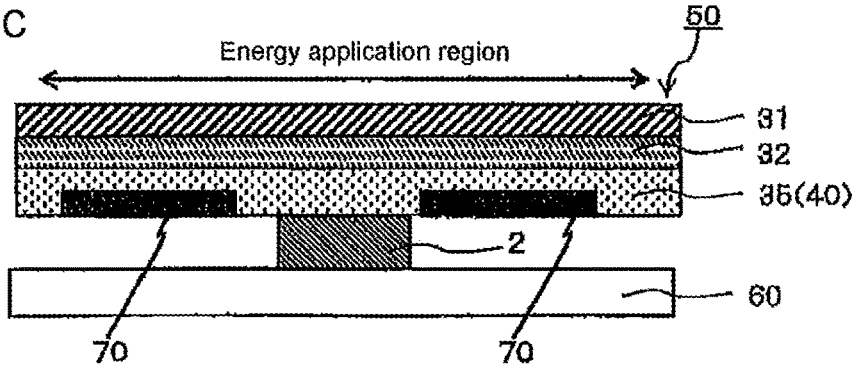
Figure 8D:
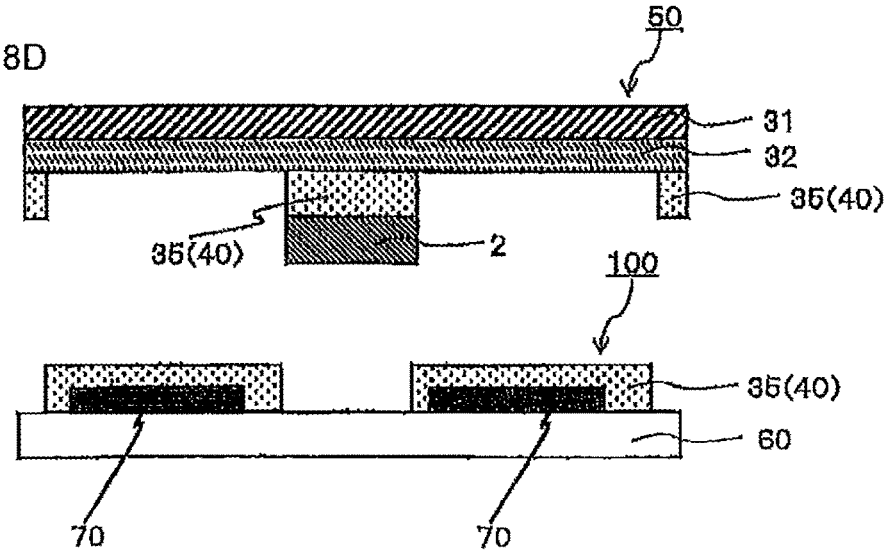

Subsequently, as shown in FIG. 8C, the transfer layer 40 of the intermediate transfer medium 50 with the inhibit layer 2 transferred thereon is superposed on transfer receiving article 60. Energy is applied to the back face side of the intermediate transfer medium 50 (in the form shown in FIG. 8C, the upper face of the intermediate transfer medium 50), for example, with a heating member such as a thermal head (not shown). The transfer layer 40 corresponding to a region to which energy has been applied (see the energy application region of FIG. 8C) is transferred onto the transfer receiving article 60. In this respect, the inhibit layer 2 transferred onto the transfer layer 40 of the intermediate transfer medium 50 plays a role as a masking member. As shown in FIGS. 8C and 8D, in the transfer layer 40 corresponding to the region to which energy has been applied, only the transfer layer 40 in a region having no overlap with the inhibit layer 2 is transferred onto the transfer receiving article 60 so that print 100 can be produced in a form as shown in FIG. 8D. That is, the thermal transfer sheet 10 of one embodiment is thermal transfer sheet 10 that is used for transferring the inhibit layer 2 onto the transfer layer 40 of the intermediate transfer medium 50. Specifically, this thermal transfer sheet 10 is used for transferring the inhibit layer 2 onto a region of the transfer layer 40 that is not desired to be transferred onto the transfer receiving article 60, in the region of the transfer layer 40 to which energy has been applied when the print is produced by transferring the transfer layer 40 of the intermediate transfer medium 50 onto the transfer receiving article 60.

Hereinafter, each configuration of the thermal transfer sheet 10 of one embodiment that is used for the purpose described above will be described by taking one example.

(Substrate)

The substrate 1 constituting the thermal transfer sheet 10 of one embodiment is not limited by any means, and a substrate heretofore known in the thermal transfer sheet field can be appropriately selected and used. One example thereof includes: tissue papers such as glassine paper, capacitor paper, and paraffin paper; and stretched or unstretched films of various plastics, for example, polyesters having high heat resistance such as polyethylene terephthalate, polyethylene naphthalate, polybutylene terephthalate, polyphenylene sulfide, polyether ketone, and polyether sulfone, polypropylenes, polycarbonate, cellulose acetates, polyethylene derivatives, polyvinyl chloride, polyvinylidene chloride, polystyrenes, polyamides, polyimides, polymethylpentene, and ionomers. A composite film obtained by laminating two or more of these materials can also be used.

The thickness of the substrate 1 is not particularly limited and is preferably 2 μm or larger and 10 μm or smaller. In order to improve the adhesion between the substrate 1 and the inhibit layer 2, the surface of the substrate 1 may be subjected to easy-adhesive treatment. That is, substrate 1 that has undergone easy-adhesive treatment may be used. Examples of the easy-adhesive treatment include known resin surface modification techniques such as corona discharge treatment, flame treatment, ozone treatment, ultraviolet treatment, radiation treatment, roughening treatment, chemical treatment, plasma treatment, low-temperature plasma treatment, and grafting treatment. Two or more of these treatments may be used in combination.

Next, the inhibit layer 2 of the thermal transfer sheet 10 of one embodiment that is used for the purpose described above will be described by taking a first form of the inhibit layer and a second form of the inhibit layer as examples.

(First Form of Inhibit Layer)

The first form of the inhibit layer 2 contains a carnauba wax. According to the first form of the inhibit layer 2 containing the carnauba wax, the inhibit layer 2 is transferred onto the transfer layer 40 of the intermediate transfer medium 50, and the transfer layer 40 of the intermediate transfer medium 50 including a region with the inhibit layer 2 transferred thereon is transferred onto the transfer receiving article 60. In this respect, in the region of the transfer layer 40 to which energy has been applied, only the transfer layer 40 in a region having no overlap with the inhibit layer 2 can be accurately transferred onto the transfer receiving article 60. In other words, the foil cutting properties can be good when the transfer layer 40 of the intermediate transfer medium 50 is transferred.

The foil cutting properties of the transfer layer 40 described in the present specification refer to the degree of suppression of tailing in transferring the transfer layer onto the transfer receiving article. Good foil cutting properties mean that the occurrence of tailing can be sufficiently suppressed. That is, the term means that in the transfer layer 40 corresponding to the region to which energy has been applied, only the transfer layer 40 in a region having no overlap with the inhibit layer 2 can be transferred onto the transfer receiving article 60. The tailing described in the present specification means a phenomenon in which, when the transfer layer 40 is transferred onto the transfer receiving article 60, the transfer layer 40 is transferred by originating from the boundary between the transfer layer 40 in a region having an overlap with the inhibit layer 2 (non-transfer region) and the transfer layer 40 in the region having no overlap with the inhibit layer (transfer region) in the transfer layer 40 corresponding to the region to which energy has been applied, so that the transfer layer 40 protrudes from the boundary toward the region side having an overlap with the inhibit layer 2 (non-transfer region side). In other words, the tailing means a phenomenon in which a part of the transfer layer 40 in the non-transfer region supposed to remain on the intermediate transfer medium 50 side is transferred onto the transfer receiving article 60 side.

The first form of the inhibit layer 2 can further prevent a lack of transfer of the transfer layer 40 in which in the region to which energy has been applied, the whole or a part of the transfer layer 40 of the transfer region is not transferred onto the transfer receiving article 60. The lack of transfer of the transfer layer described in the present specification means a phenomenon in which the transfer layer 40 supposed to be transferred onto the transfer receiving article 60 side remains on the support 31 side of the intermediate transfer medium 50, by originating from the boundary between the transfer layer of the non-transfer region and the transfer layer of the transfer region, without being transferred onto the transfer receiving article in a partial region from the boundary.

The content of the carnauba wax is not particularly limited and is preferably 30% by mass or more, more preferably 40% by mass or more, with respect to the total mass of the inhibit layer 2. The upper limit value is not particularly limited and is 100% by mass. The first form of the inhibit layer 2 may contain one carnauba wax or may contain two or more carnauba waxes.

Preferably, the first form of the inhibit layer 2 contains a polyethylene wax and a thermoplastic elastomer, in addition to the carnauba wax. This preferred first form of the inhibit layer 2 can more effectively prevent tailing when the transfer layer 40 of the intermediate transfer medium 50 including the region with the inhibit layer 2 transferred thereon is transferred onto the transfer receiving article 60.

Examples of the thermoplastic elastomer include styrene elastomers, olefin elastomers, urethane elastomers, polyester elastomers, polyamide elastomers, 1,2-polybutadiene elastomers, and vinyl chloride elastomers. Particularly, styrene-butadiene rubber can be suitably used. The first form of the inhibit layer 2 may contain one polyethylene wax or thermoplastic elastomer or may contain two or more polyethylene waxes or thermoplastic elastomers.

The first form of the inhibit layer 2 preferably contains 30% by mass or more, more preferably 40% by mass or more, of the polyethylene wax with respect to the total mass of the inhibit layer 2. Also, the first form of the inhibit layer 2 preferably contains 1% by mass or more, more preferably 5% by mass or more, of the thermoplastic elastomer with respect to the total mass of the inhibit layer 2. It is particularly preferred that the first form of the inhibit layer 2 should contain the carnauba wax at the preferred content described above and contain the polyethylene wax and the thermoplastic elastomer at the preferred contents described above.

The method for forming the first form of the inhibit layer is not particularly limited. The first form of the inhibit layer can be formed, for example, by dispersing or dissolving the carnauba wax and various additives to be optionally added in an appropriate solvent to prepare a coating liquid for the inhibit layer, and coating the substrate 1 or an arbitrary layer disposed on the substrate 1 with the coating liquid, followed by drying. The coating method with the coating liquid for the inhibit layer is not particularly limited, and a heretofore known coating method can be appropriately selected and used. Examples of the coating method include gravure printing method, screen printing method, and reverse-coating method using a gravure plate. Alternatively, any of other coating methods may be used. This holds true for coating methods with various coating liquids mentioned later.

The thickness of the first form of the inhibit layer 2 is not particularly limited and is preferably 0.05 μm or larger and 5 μm or smaller, more preferably 0.1 μm or larger and 1.5 μm or smaller. When the thickness of the first form of the inhibit layer 2 falls within the preferred thickness range described above, only the transfer layer 40 in the region having no overlap with the inhibit layer 2 in the region to which energy has been applied can be transferred onto the transfer receiving article 60 with good foil cutting properties. Furthermore, the foil cutting properties of the inhibit layer 2 can be good when the inhibit layer 2 is transferred onto the transfer layer 40 of the intermediate transfer medium 50. This folds true for the second form of the inhibit layer 2.

(Second Form of Inhibit Layer)

The second form of the inhibit layer 2 contains at least one member selected from the group consisting of a cured product of an active ray-curable resin, a cured product of a silicone resin, and a cured product of a thermoplastic resin. The second form of the inhibit layer 2 exerts the same working effects as those of the first form of the inhibit layer 2.

In the production of a print using the thermal transfer sheet of one embodiment, the inhibit layer 2 is transferred onto the intermediate transfer medium 50 and comes into contact with the transfer receiving article 60 (see FIG. 8C) when the transfer layer 40 of the intermediate transfer medium 50 is transferred onto the transfer receiving article 60. Since the transfer layer 40 of the intermediate transfer medium 50 is not transferred onto a region, in contact with the inhibit layer 2, of the transfer receiving article 60, the surface of the transfer receiving article 60 in the region in contact with the inhibit layer 2 may be exposed to the produced print (see FIG. 8D). Thus, for the selection of the transfer receiving article 60, a transfer receiving article having surface performance that does not allow or rarely allows a scratch mark to remain when its surface is rubbed with a material having a sharp tip, such as a nail, can be used in order to maintain favorable appearance of the produced print.

The inhibit layer capable of coming into contact with the transfer receiving article preferably has a property of having no or few adverse effects on the original surface performance of the transfer receiving article. The second form of the inhibit layer 2 is suitable because of having such a property. Thus, according to the thermal transfer sheet of one embodiment having the second form of the inhibit layer 2, a print that can maintain favorable appearance can be produced using the thermal transfer sheet 10.

(Cured Product of Active Ray-Curable Resin)

The second form of the inhibit layer 2 as one example contains a cured product of an active ray-curable resin. According to the second form of the inhibit layer 2, as in the first form of the inhibit layer 2, the second form of the inhibit layer 2 is transferred onto the transfer layer 40 of the intermediate transfer medium 50, and the transfer layer 40 of the intermediate transfer medium 50 including a region with the inhibit layer 2 transferred thereon is transferred onto the transfer receiving article 60. In this respect, in the region of the transfer layer 40 to which energy has been applied, only the transfer layer 40 in a region having no overlap with the inhibit layer 2 can be accurately transferred onto the transfer receiving article 60. The same holds true for the second form of the inhibit layer 2 containing a cured product of a silicone resin or a cured product of a thermoplastic resin described below.

The active ray-curable resin described in the present specification means a precursor or a composition before irradiation with active ray. The active ray described in the present specification means radiation that is allowed to act chemically on the active ray-curable resin to promote polymerization, and specifically means visible ray, ultraviolet ray, X ray, electron beam, α ray, β ray, γ ray, or the like. Hereinafter, preferred forms of the active ray-curable resin will be described.

The active ray-curable resin constituting the cured product of an active ray-curable resin contains a composition or the like having an appropriate mixture of a polymer, a prepolymer, an oligomer, and/or a monomer having a polymerizable unsaturated bond such as a (meth)acryloyl group and a (meth)acryloyloxy group, or an epoxy group in the molecule, as a polymerizable component.

The active ray-curable resin as one example contains urethane (meth)acrylate as a polymerizable component and preferably contains polyfunctional urethane (meth)acrylate. The polyfunctional urethane (meth)acrylate is preferably polyfunctional urethane (meth)acrylate having 5 or more and 15 or less functional groups, more preferably polyfunctional urethane (meth)acrylate having 6 or more and 15 or less functional groups. The (meth)acrylate described in the present specification includes acrylate and methacrylate. The (meth)acrylic acid includes acrylic acid and methacrylic acid. The (meth)acrylic acid ester includes acrylic acid ester and methacrylic acid ester.

The polyfunctional urethane (meth)acrylate serving as a polymerizable component preferably has a weight average molecular weight of 400 or larger and 20000 or smaller, more preferably 500 or larger and 10000 or smaller. Use of the polyfunctional urethane (meth)acrylate having its weight average molecular weight that falls within the preferred range described above can improve foil cutting properties and can allow the inhibit layer 2 to be transferred in an intended shape onto the transfer layer 40 of the intermediate transfer medium. In the specification of the present application, the "weight average molecular weight" means a value measured by gel permeation chromatography with polystyrene as standards, and can be measured by a method conforming to JIS-K-7252-1 (2008).

The active ray-curable resin as one example contains an unsaturated bond-containing (meth)acrylate copolymer (hereinafter, also referred to as an unsaturated bond-containing acrylic copolymer) as a polymerizable component. Examples of the unsaturated bond-containing (meth)acrylate copolymer include polyester (meth)acrylate, epoxy (meth) acrylate, melamine (meth)acrylate, and triazine (meth)acrylate.

The active ray-curable resin may contain an oligomer and/or a monomer other than the unsaturated bond-containing acrylic copolymer, such as (meth)acrylic acid, styrene, vinyl acetate, hydroxyethyl vinyl ether, ethylene glycol divinyl ether, pentaerythritol trivinyl ether, (meth)acrylamide, N-hydroxymethyl(meth)acrylamide, N-vinylformamide, and acrylonitrile, as a polymerizable component. Also, the active ray-curable resin may contain a prepolymer, an oligomer and/or a monomer as described below.

Examples of the prepolymer include: polyester (meth) acrylates prepared by introducing (meth)acrylic acid to polyester obtained through the binding between a polybasic acid such as adipic acid, trimellitic acid, maleic acid, phthalic acid, terephthalic acid, nadic acid, malonic acid, succinic acid, glutaric acid, itaconic acid, pyromellitic acid, fumaric acid, pimelic acid, sebacic acid, dodecanoic acid, or tetrahydrophthalic acid and a polyhydric alcohol such as ethylene glycol, propylene glycol, diethylene glycol, propylene oxide, 1,4-butanediol, triethylene glycol, tetraethylene glycol, polyethylene glycol, glycerin, trimethylolpropane, pentaerythritol, sorbitol, 1,6-hexanediol, or 1,2,6-hexanetriol; epoxy (meth)acrylates prepared by introducing (meth)acrylic acid to epoxy resins, such as bisphenol A-epichlorohydrin-(meth)acrylic acid and phenol novolac-epichlorohydrin-(meth)acrylic acid; urethane (meth)acrylates prepared by introducing (meth)acrylic acid to polyurethane, such as ethylene glycol-adipic acid-tolylene diisocyanate-2-hydroxyethyl acrylate, polyethylene glycol-tolylene diisocyanate-2-hydroxyethyl acrylate, hydroxyethylphthalyl methacrylate-xylene diisocyanate, 1,2-polybutadiene glycol-tolylene diisocyanate-2-hydroxyethyl acrylate, and trimethylolpropane-propylene glycol-tolylene diisocyanate-2-hydroxyethyl acrylate; silicone resin acrylates such as polysiloxane (meth)acrylate and polysiloxane-diisocyanate-2-hydroxyethyl (meth)acrylate; alkyd-modified (meth) acrylates prepared by introducing a (meth)acryloyl group to oil-modified alkyd resins; and spiran resin acrylates.

Examples of the monomer or the oligomer can include monofunctional acrylic acid esters such as 2-ethylhexyl acrylate, 2-hydroxypropyl acrylate, glycerol acrylate, tetrahydrofurfuryl acrylate, phenoxyethyl acrylate, nonylphenoxyethyl acrylate, tetrahydrofurfuryloxyethyl acrylate, tetrahydrofurfuryloxyhexanolide acrylate, acrylates of ε caprolactone adducts of 1,3-dioxane alcohol, and 1,3-dioxolane acrylate.

Specific examples thereof can include: difunctional acrylic acid esters such as ethylene glycol diacrylate, triethylene glycol diacrylate, pentaerythritol diacrylate, hydroquinone diacrylate, resorcin diacrylate, hexanediol diacrylate, neopentyl glycol diacrylate, tripropylene glycol diacrylate, neopentyl glycol hydroxypivalate diacrylate, neopentyl glycol adipate diacrylate, diacrylates of ε-caprolactone adducts of neopentyl glycol hydroxypivalate, 2-(2-hydroxy-1,1-dimethylethyl)-5-hydroxymethyl-5-ethyl-1,3-dioxane diacrylate, tricyclodecane dimethylol acrylate, ε-caprolactone adducts of tricyclodecane dimethylol acrylate, and 1,6-hexanediol diglycidyl ether diacrylate; polyfunctional acrylic acid esters such as trimethylolpropane triacrylate, ditrimethylolpropane tetraacrylate, trimethylolethane triacrylate, pentaerythritol triacrylate, pentaerythritol tetraacrylate, dipentaerythritol tetraacrylate, dipentaerythritol pentaacrylate, dipentaerythritol hexaacrylate, ε-caprolactone adducts of dipentaerythritol hexaacrylate, pyrogallol triacrylate, propionic acid-dipentaerythritol triacrylate, propionic acid-dipentaerythritol tetraacrylate, and hydroxypivalyl aldehyde-modified dimethylolpropane triacrylate; and phosphazene monomers, triethylene glycol, isocyanuric acid EO-modified diacrylate, isocyanuric acid EO-modified triacrylate, dimethyloltricyclodecane diacrylate, trimethylolpropane acrylic acid benzoic acid ester, alkylene glycol type acrylic acid modified, and urethane-modified acrylate. Alternatively, methacrylic acid, itaconic acid, crotonic acid, or maleic acid ester, or the like may be used by using methacrylate, itaconate, crotonate, or maleate instead of these acrylates.

The second form of the inhibit layer 2 containing the cured product of an active ray-curable resin preferably contains 30% by mass or more, more preferably 50% by mass or more, of the cured product of an active ray-curable resin with respect to the total mass of the inhibit layer 2. The upper limit value is not particularly limited and can be appropriately set according to a component to be optionally added, etc. One example thereof is 100% by mass.

The second form of the inhibit layer 2 may contain a cured product of one active ray-curable resin alone or may contain cured products of two or more active ray-curable resins. Also, the second form of the inhibit layer 2 may contain an additional resin in addition to the cured product of an active ray-curable resin. The additional resin may be cured with a curing agent or the like or may be uncured.

The second form of the inhibit layer 2 may contain an additional component in addition to the cured product of an active ray-curable resin. Examples of the additional component include fillers. The filler contained in the second form of the inhibit layer 2 in addition to the cured product of an active ray-curable resin can improve the foil cutting properties of the inhibit layer 2 to be transferred onto the transfer layer 40 of the intermediate transfer medium 50.

Examples of the filler include organic fillers, inorganic fillers, and organic-inorganic hybrid type fillers. The filler may be a powder or may be a sol, and a powder of the filler is preferably used because the selectivity of a solvent is wide for preparing the coating liquid for the inhibit layer.

The volume average particle size of the filler contained in the second form of the inhibit layer 2 is preferably 1 nm or larger and 1 μm or smaller, more preferably 1 nm or larger and 50 nm or smaller, further preferably 7 nm or larger and 25 nm or smaller. When the filler having its volume average particle size that falls within the range described above is contained in the second form of the inhibit layer 2, transferability can be further improved. The "volume average particle size" means a particle size measured in accordance with JIS-Z-8819-2 (2001), and is a value measured using a particle size distribution measurement apparatus (Nanotrac Particle Size Distribution Analyzer, Nikkiso Co., Ltd.).

Examples of the powder of the organic filler can include acrylic particles such as non-cross-linked acrylic particles and cross-linked acrylic particles, polyamide particles, fluorine particles, polyethylene waxes, and silicone particles. Examples of the powder of the inorganic filler include calcium carbonate particles, silica particles, and metal oxide (e.g., titanium oxide) particles. Examples of the organic-inorganic hybrid type filler include hybrids of acrylic resins and silica particles. Examples of the sol of the filler include silica sol type and organosol type. One of these fillers may be used alone, or two or more thereof may be used as a mixture. Among them, silica particles are suitable.

The content of the filler with respect to the total mass of the second form of the inhibit layer 2 is preferably 10% by mass or more and 60% by mass or less, more preferably 10% by mass or more and 50% by mass or less, further preferably 20% by mass or more and 40% by mass or less.

The thickness of the second form of the inhibit layer 2 is not particularly limited and is preferably 1 μm or larger and 15 μm or smaller, more preferably 2 μm or larger and 6 μm or smaller. When the thickness of the second form of the inhibit layer 2 falls within this range, foil cutting properties can be further improved.

The method for forming the second form of the inhibit layer 2 containing the cured product of an active ray-curable resin is not particularly limited. The second form of the inhibit layer 2 containing the cured product of an active ray-curable resin can be formed by preparing a coating liquid for the inhibit layer containing the active ray-curable resin and an optional component, coating the substrate 1 with this coating liquid, followed by drying to form a coating film of the inhibit layer, and irradiating this coating film with active ray so that the polymerizable component such as the polymerizable copolymer is cross-linked to cure the resin. In the case of performing ultraviolet irradiation as the irradiation with active ray, a heretofore known ultraviolet irradiation apparatus can be used, and various apparatuses, for example, a high-pressure mercury lamp, a low-pressure mercury lamp, a carbon arc, a xenon arc, a metal halide lamp, an electrodeless ultraviolet lamp, and LED, can be used without limitations. In the case of performing electron beam irradiation as the irradiation with active ray, for example, a high-energy type electron beam irradiation apparatus which emits electron beam at an energy of 100 keV or higher and 300 keV or lower, or a low-energy type electron beam irradiation apparatus which emits electron beam at an energy of 100 keV or lower can be used. The irradiation method may also be any method of scanning type and curtain type irradiation apparatuses.

(Cured Product of Silicone Resin)

The second form of the inhibit layer 2 as one example contains a cured product of a silicone resin. The silicone resin constituting the cured product of a silicone resin may be a resin having a siloxane bond in the backbone structure, or may be any of various silicone-modified resins. Examples of the silicone-modified resin include silicone-modified acrylic resins. The second form of the inhibit layer 2 may contain a cured product of one silicone resin or may contain cured products of two or more silicone resins.

For example, a heretofore known curing catalyst such as a hydrosilylation addition reaction curing type curing catalyst, a condensation reaction curing type curing catalyst, or an organic peroxide can be used as a curing catalyst for curing the silicone resin.

The second form of the inhibit layer 2 containing the cured product of a silicone resin preferably contains 5% by mass or more, more preferably 30% by mass or more, of the cured product of a silicone resin with respect to the total mass of the inhibit layer 2.

The method for forming the second form of the inhibit layer containing the cured product of a silicone resin is not particularly limited. The second form of the inhibit layer containing the cured product of a silicone resin can be formed by dispersing or dissolving the silicone resin, the curing catalyst, etc. in an appropriate solvent to prepare a coating liquid for the inhibit layer, and coating the substrate 1 with this coating liquid, followed by drying.

(Cured Product of Thermoplastic Resin)

The second form of the inhibit layer 2 as one example contains a cured product of a thermoplastic resin. Examples of the thermoplastic resin constituting the cured product of a thermoplastic resin include polyester, polyacrylic acid ester, polyvinyl acetate, acrylic-styrene copolymers, polyurethane, polyolefins such as polyethylene and polypropylene, polystyrene, polyvinyl chloride, polyether, polyamide, polyimide, polyamide imide, polycarbonate, polyacrylamide, polyvinyl acetal such as polyvinyl butyral and polyvinyl acetoacetal, and their silicone-modified forms. Among them, for example, polyamide imide or a silicone-modified product thereof can be preferably used from the viewpoint of heat resistance, etc. The second form of the inhibit layer 2 may contain a cured product of one thermoplastic resin or may contain cured products of two or more thermoplastic resins.

Examples of the curing agent for obtaining the cured product of a thermoplastic resin include isocyanate type curing agents.

The second form of the inhibit layer 2 containing the cured product of a thermoplastic resin preferably contains 5% by mass or more, more preferably 50% by mass or more, of the cured product of a thermoplastic resin with respect to the total mass of the inhibit layer 2.

The method for forming the second form of the inhibit layer containing the cured product of a thermoplastic resin is not particularly limited. The second form of the inhibit layer containing the cured product of a silicone resin can be formed, for example, by dispersing or dissolving the thermoplastic resin, the curing agent, etc. in an appropriate solvent to prepare a coating liquid for the inhibit layer, and coating the substrate 1 with this coating liquid, followed by drying.

The second form of the inhibit layer 2 may contain two or more members selected from the group consisting of the cured product of an active ray-curable resin, the cured product of a silicone resin, and the cured product of a thermoplastic resin. In this case, the total mass of these two or more cured products is preferably 10% by mass or more, more preferably 50% by mass or more, with respect to the total mass of the second form of the inhibit layer 2.

(Adhesive Layer)

Figure 2:
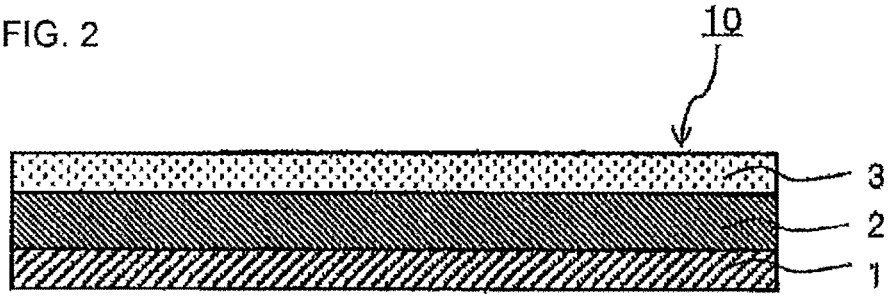
FIG. 2 is a schematic cross-sectional view of the thermal transfer sheet of one embodiment.

As shown in FIG. 2, a configuration in which adhesive layer 3 is disposed on the inhibit layer 2 may be adopted. According to the thermal transfer sheet 10 having the form shown in FIG. 2, the adhesive layer 3 disposed on the inhibit layer 2 can attain favorable adhesion between the transfer layer 40 of the intermediate transfer medium 50 and the inhibit layer 2 when the inhibit layer 2 is transferred onto the receiving layer 35 of the intermediate transfer medium 50.

The adhesive layer 3 contains a component having an adhesive property to the transfer layer 40 of the intermediate transfer medium 50. Examples of the component having an adhesive property include polyurethane, polyolefins such as α-olefin-maleic anhydride, polyester, acrylic resins, epoxy resins, urea resins, melamine resins, phenol resins, vinyl acetate, vinyl chloride-vinyl acetate copolymers, and cyano acrylate. Alternatively, any of these resins cured with a curing agent may be used. The curing agent is generally an isocyanate compound, and aliphatic amine, cyclic aliphatic amine, aromatic amine, acid anhydride, or the like can be used.

The method for forming the adhesive layer 3 is not particularly limited. The adhesive layer 3 can be formed by dispersing or dissolving the component having an adhesive property and various additives to be optionally added in an appropriate solvent to prepare a coating liquid for the adhesive layer, and coating the inhibit layer 2 with this coating liquid, followed by drying. The thickness of the adhesive layer is preferably 0.5 μm or larger and 10 μm or smaller, more preferably 0.8 μm or larger and 2.0 μm or smaller.

(Dye Layer)

Figure 3:
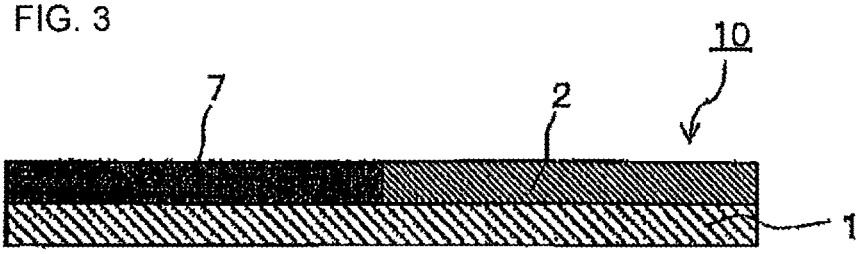
FIG. 3 is a schematic cross-sectional view of the thermal transfer sheet of one embodiment.

As shown in FIG. 3, a configuration in which dye layer 7 and the inhibit layer 2 are disposed as being frame sequentially on the same surface of the substrate 1 may be adopted. According to the thermal transfer sheet 10 shown in FIG. 3, the formation of a thermal transfer image on the transfer layer 40 of the intermediate transfer medium 50 and the transfer of the inhibit layer 2 onto the transfer layer 40 of the intermediate transfer medium 50 can be performed using one thermal transfer sheet. In the form shown in FIG. 3, adhesive layer 3 may be disposed on the inhibit layer 2. The same holds true for thermal transfer sheet 10 having the form shown in FIG. 4 or 5.

The dye layer 7 as one example contains a binder resin and a sublimable dye. The binder resin contained in the dye layer 7 is not particularly limited, and a binder resin heretofore known in the dye layer field can be appropriately selected and used. Examples of the binder resin for the dye layer 7 include: cellulose resins such as ethylcellulose, hydroxyethylcellulose, ethylhydroxycellulose, methylcellulose, and cellulose acetate; vinyl resins such as polyvinyl alcohol, polyvinyl acetate, polyvinyl butyral, polyvinyl acetoacetal, and polyvinylpyrrolidone; acrylic resins such as poly(meth)acrylate and poly(meth)acrylamide; and polyurethane, polyamide, and polyester.

The content of the binder resin is not particularly limited, and the binder resin is preferably contained at 20% by mass or more with respect to the total mass of the dye layer 7. When the content of the binder resin with respect to the total mass of the dye layer is 20% by mass or more, the sublimable dye can be sufficiently retained in the dye layer 7. As a result, storage stability can be improved. The upper limit value of the content of the binder resin is not particularly limited and can be appropriately set according to the contents of the sublimable dye and optional additives.

The sublimable dye contained in the dye layer 7 is not particularly limited and is preferably a sublimable dye that has sufficient coloring strength and is neither discolored nor faded due to light, heat, temperature, etc. Examples of the dye include diarylmethane type dyes, triarylmethane type dyes, thiazole type dyes, merocyanine dyes, pyrazolone dyes, methine type dyes, indoaniline type dyes, azomethine type dyes such as acetophenoneazomethine, pyrazoloazomethine, imidazoleazomethine, imidazoazomethine, and pyridoneazomethine, xanthene type dyes, oxazine type dyes, cyanostyrene type dyes such as dicyanostyrene and tricyanostyrene, thiazine type dyes, azine type dyes, acridine type dyes, azo type dyes such as benzene azo type dyes, pyridone azo, thiophene azo, isothiazole azo, pyrrole azo, pyrazole azo, imidazole azo, thiadiazole azo, triazole azo, and disazo, spiropyran type dyes, indolinospiropyran type dyes, fluoran type dyes, rhodamine lactam type dyes, naphthoquinone type dyes, anthraquinone type dyes, and quinophthalone type dyes. Specific examples thereof include: red dyes such as MSRedG (Mitsui Chemicals, Inc.), Macrolex Red Violet R (Bayer AG), Ceres Red 7B (Bayer AG), and Samaron Red F3BS (Mitsubishi Chemical Corp.); yellow dyes such as Foron Brilliant Yellow 6GL (Clariant AG), PTY-52 (Mitsubishi Chemical Corp.), and Macrolex Yellow 6G (Bayer AG); and blue dyes such as Kayaset® Blue 714 (Nippon Kayaku Co., Ltd.), Foron Brilliant Blue S-R (Clariant AG), MS Blue 100 (Mitsui Chemicals, Inc.), and C.I. sorbent blue 63.

The content of the sublimable dye is preferably 50% by mass or more and 350% by mass or less, more preferably 80% by mass or more and 300% by mass or less, with respect to the total mass of the binder resin. When the content of the sublimable dye falls within the preferred range described above, printing density and storage stability can be further improved.

(Dye Primer Layer)

A dye primer layer (not shown) may be disposed between the substrate 1 and the dye layer 7. Examples of the component contained in the dye primer layer include, but are not particularly limited to, polyester, polyvinylpyrrolidone, polyvinyl alcohol, hydroxyethylcellulose, polyacrylic acid ester, polyvinyl acetate, polyurethane, acrylic-styrene copolymers, polyacrylamide, polyamide, polyether, polystyrene, polyethylene, polypropylene, polyvinyl chloride, and polyvinyl acetals such as polyvinyl acetoacetal and polyvinyl butyral.

The dye primer layer may contain colloidal inorganic pigment ultrafine particles. Examples of the colloidal inorganic pigment ultrafine particles include silica (colloidal silica), alumina, alumina hydrates (alumina sol, colloidal alumina, cationic aluminum oxide or hydrates thereof, pseudoboehmite, etc.), aluminum silicate, magnesium silicate, magnesium carbonate, magnesium oxide, and titanium oxide. Particularly, colloidal silica or alumina sol is preferably used. The size of these colloidal inorganic pigment ultrafine particles is preferably 100 nm or smaller, more preferably 50 nm or smaller, in terms of a primary average particle size.

In the form shown in the drawing, one dye layer and the inhibit layer 2 are disposed as being frame sequentially. However, a plurality of dye layers and the inhibit layer 2 may be disposed as being frame sequentially. For example, in the thermal transfer sheet 10 having the form shown in FIG. 3, the configuration of the dye layer 7 may be a configuration in which two or all of yellow (Y), magenta (M), and cyan (C) dye layers are disposed as being frame sequentially. Alternatively, a configuration in which these dye layers and a fusible layer are disposed as being frame sequentially may be adopted.

(Heat-Seal Layer)

Figure 4:
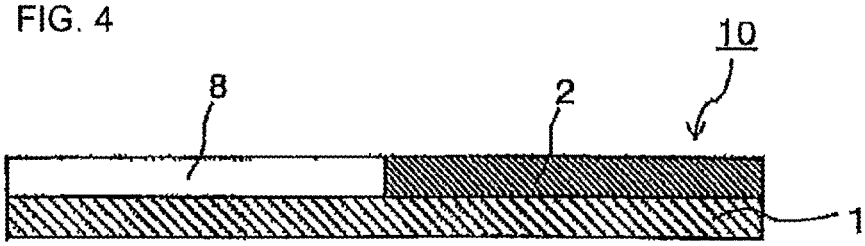
FIG. 4 is a schematic cross-sectional view of the thermal transfer sheet of one embodiment.

As shown in FIG. 4, a configuration in which heat-seal layer 8 and the inhibit layer 2 are disposed as being frame sequentially on the same surface of the substrate 1 may be adopted.

According to the thermal transfer sheet 10 having the form shown in FIG. 4, the transfer of the inhibit layer 2 onto the transfer layer 40 of the intermediate transfer medium 50, and the transfer of the heat-seal layer 8 onto the transfer layer 40 before or after the transfer of the inhibit layer 2 can be performed using one thermal transfer sheet. According to this form of the thermal transfer sheet 10, the heat-seal layer 8 is transferred onto the transfer layer 40 of the intermediate transfer medium 50 at a stage before transfer of the transfer layer 40 onto the transfer receiving article 60 so that the transfer receiving article 60 and the transfer layer 40 can adhere tightly to each other via the heat-seal layer. This can improve the adhesion between the transfer receiving article 60 and the transfer layer 40. The thermal transfer sheet 10 having the form shown in FIG. 4 is suitable, for example, when the receiving layer 35 positioned on the outermost surface of the intermediate transfer medium 50 has no adhesive property.

Examples of the binder resin for the heat-seal layer 8 as one example include UV absorbers, acrylic resins, vinyl chloride-vinyl acetate copolymers, epoxy resins, polyester, polycarbonate, acetal resins, polyamide, and vinyl chloride. The heat-seal layer 8 may contain one binder resin alone or may contain two or more binder resins.

The method for forming the heat-seal layer 8 is not particularly limited. The heat-seal layer 8 can be formed by dispersing or dissolving the binder resin and a UV absorber, an antioxidant, a fluorescent whitening agent, an inorganic or organic filler component, a surfactant, a release agent, and the like to be optionally added in an appropriate solvent, and coating the substrate 1 with the resulting coating liquid for the heat-seal layer, followed by drying. The thickness of the heat-seal layer 8 is not particularly limited and is preferably 0.5 μm or larger and 10 μm or smaller, more preferably 0.8 μm or larger and 2 μm or smaller.

(Release Layer)

A release layer (not shown) for improving the transferability of the inhibit layer 2 or the heat-seal layer 8 may be disposed between the substrate 1 and the inhibit layer 2 or between the substrate 1 and the heat-seal layer 8. The release layer is a layer that remains on the substrate 1 side when the inhibit layer 2 is transferred onto the transfer layer 40 of the intermediate transfer medium 50 or when the heat-seal layer 8 is transferred onto the transfer layer 40.

Examples of the binder resin for the release layer include, but are not limited to, waxes, silicone waxes, silicone resins, silicone-modified resins, fluorine-containing resins, fluorine-modified resins, polyvinyl alcohol, acrylic resins, thermosetting epoxy-amino copolymers, and thermosetting alkyd-amino copolymers (thermosetting amino alkyd resins). The release layer may contain one binder resin or may contain two or more binder resins. The release layer may be formed using a composition containing the binder resin listed above as well as a cross-linking agent such as an isocyanate compound, and a catalyst such as a tin type catalyst or an aluminum type catalyst. Alternatively, release layer 32 of the intermediate transfer medium 50 mentioned later may be appropriately selected and used. The thickness of the release layer is generally 0.2 μm or larger and 5 μm or smaller. As for the method for forming the release layer, the release layer can be formed by dissolving or dispersing the binder resin in an appropriate solvent to prepare a coating liquid for the release layer, and coating the substrate 1 with this coating liquid, followed by drying.

Figure 5A:
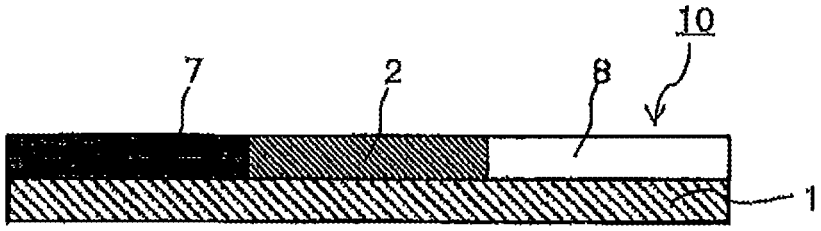
FIGS. 5A and 5B are a schematic cross-sectional view of the thermal transfer sheet of one embodiment.
Figure 5B:
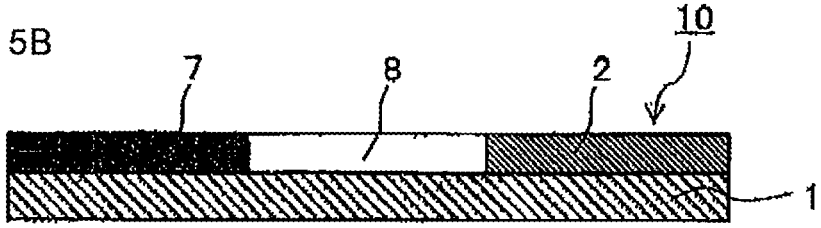

As shown in FIG. 5, a configuration in which the dye layer 7, the heat-seal layer 8, and the inhibit layer 2 are disposed as being frame sequentially on the same surface of the substrate 1 may be adopted. The order of arrangement of these layers is not particularly limited. A configuration as shown in FIG. 5A in which the dye layer 7, the inhibit layer 2, and the heat-seal layer 8 are disposed as being frame sequentially on the same surface of the substrate 1, or a configuration as shown in FIG. 5B in which the dye layer 7, the heat-seal layer 8, and the inhibit layer 2 are disposed as being frame sequentially on the same surface of the substrate 1, is preferred.

(Back Face Layer)

A back face layer (not shown) may be disposed on the other surface of the substrate 1. Examples of the material for the back face layer include, but are not limited to, natural or synthetic resins, for example: cellulose resins such as cellulose acetate butyrate and cellulose acetate propionate; polyvinyl acetals such as polyvinyl butyral and polyvinyl acetoacetal; acrylic resins such as polymethyl methacrylate, polyethyl acrylate, polyacrylamide, and acrylonitrile-styrene copolymers; and polyamide, polyamide imide, polyester, polyurethane, and silicone-modified or fluorine-modified urethane, which may be used alone or as a mixture.

The back face layer may contain a solid or liquid lubricant. Examples of the lubricant include various waxes such as polyethylene wax and paraffin wax, higher aliphatic alcohols, organopolysiloxanes, anionic surfactants, cationic surfactants, amphoteric surfactants, nonionic surfactants, fluorine type surfactants, organic carboxylic acids and derivatives thereof, metallic soap, fluorine-containing resins, silicone resins, and fine particles of inorganic compounds such as talc and silica. The mass of the lubricant with respect to the total mass of the back face layer is 5% by mass or more and 50% by mass or less, preferably 10% by mass or more and 40% by mass or less.

The method for forming the back face layer is not particularly limited. The back face layer can be formed by dissolving or dispersing the resin and a lubricant and the like to be optionally added in an appropriate solvent to prepare a coating liquid for the back face layer, and coating the substrate 1 with this coating liquid, followed by drying. The thickness of the back face layer is preferably 1 μm or larger and 10 μm or smaller.

<<Combination of Thermal Transfer Sheet and Intermediate Transfer Medium<<

Next, the combination of a thermal transfer sheet and an intermediate transfer medium according to an embodiment of the present disclosure (hereinafter, referred to as the combination of one embodiment) will be described. The combination of one embodiment is a combination of thermal transfer sheet 10 and intermediate transfer medium 50, wherein the thermal transfer sheet is the thermal transfer sheet 10 of one embodiment (see FIGS. 1 to 5) described above, and the intermediate transfer medium 50 is an intermediate transfer medium in which transfer layer 40 is disposed on support 31, the transfer layer 40 having a single-layer configuration consisting of receiving layer 35 (see FIG. 6), or having a layered configuration where receiving layer 35 is positioned furthest from the support 31 (see FIG. 7).

According to the combination of one embodiment, the inhibit layer 2 of one embodiment is transferred onto the transfer layer 40 of the intermediate transfer medium 50, and the transfer layer 40 of the intermediate transfer medium including a region with the inhibit layer 2 transferred thereon is transferred onto the transfer receiving article 60. In this respect, in the region of the transfer layer 40 to which energy has been applied, only the transfer layer 40 in a region having no overlap with the inhibit layer 2 can be accurately transferred onto the transfer receiving article 60. In other words, the foil cutting properties of the transfer layer can be good when the inhibit layer 2 of one embodiment is transferred onto the transfer layer 40 of the intermediate transfer medium 50, and the transfer layer 40 of the intermediate transfer medium including a region with the inhibit layer 2 transferred thereon is transferred onto the transfer receiving article 60. Furthermore, the combination of one embodiment can prevent a lack of transfer of the transfer layer in which in the region to which energy has been applied, the whole or a part of the transfer layer in a region having no overlap with the inhibit layer 2 is not transferred onto the transfer receiving article.

Thermal Transfer Sheet which is Used in Combination of One Embodiment

The thermal transfer sheet 10 of one embodiment described above can be appropriately selected and used as the thermal transfer sheet 10 which is used in the combination of one embodiment. Thus, detailed description about the thermal transfer sheet 10 which is used in the combination of one embodiment will be omitted here.

Intermediate Transfer Medium which is Used in Combination of One Embodiment

Figure 6:
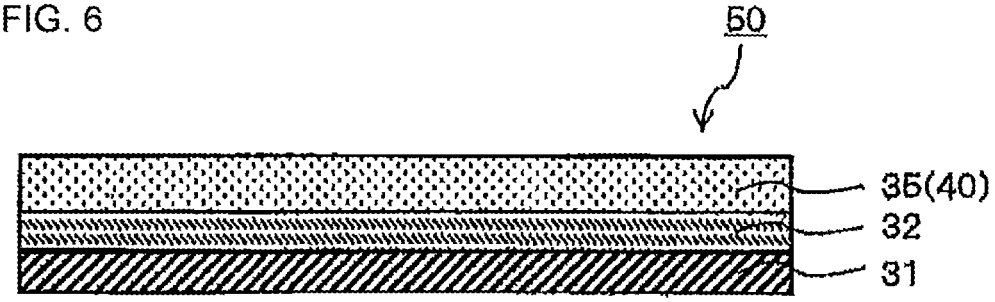
FIG. 6 is a schematic cross-sectional view of an intermediate transfer medium that is used in combination with the thermal transfer sheet of one embodiment.
Figure 7:
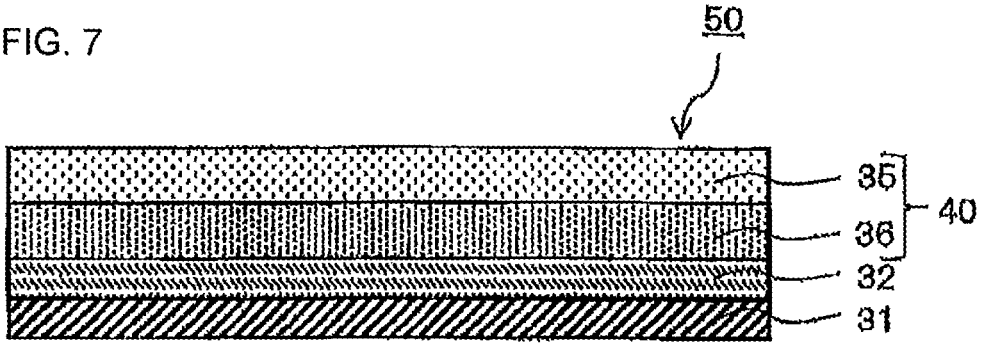
FIG. 7 is a schematic cross-sectional view of an intermediate transfer medium that is used in combination with the thermal transfer sheet of one embodiment.

The intermediate transfer medium which is used in the combination of one embodiment (hereinafter, referred to as the intermediate transfer medium) assumes a configuration, as shown in FIG. 6 or 7, in which transfer layer 40 is disposed on support 31. The transfer layer 40 is configured such that only the transfer layer is peeled from the support 31 side by the application of energy.

The transfer layer 40 may assume a single-layer configuration consisting of only the receiving layer 35, as shown in FIG. 6, or may assume a layered structure where a plurality of layers including the receiving layer 35 are layered, as shown in FIG. 7. The intermediate transfer medium 50 having the form shown in FIG. 7 has transfer layer 40 which assumes a layered structure where protective layer 36 and the receiving layer 35 are layered in the presented order from the support 31 side. Hereinafter, each configuration of the intermediate transfer medium will be described.

(Support)

The support 31 retains transfer layer 40 disposed on the support 31, and release layer 32 arbitrarily disposed between the support 31 and the transfer layer 40. The support 31 is not particularly limited, and a support heretofore known in the intermediate transfer medium field can be appropriately selected and used. Alternatively, the substrate described above about the thermal transfer sheet 10 of one embodiment may be appropriately selected and used as the support 31.

(Release Layer)

In the intermediate transfer medium 50 which is used in the combination of one embodiment, release layer 32 in direct contact with the transfer layer 40 is preferably disposed between the support 31 and the transfer layer 40. The release layer 32 is a layer that remains on the support 31 side when the transfer layer 40 is transferred onto the transfer receiving article 60, and imparts a favorable release property (also referred to as transferability) to the transfer layer 40. The release layer 32 has an arbitrary configuration in the intermediate transfer medium which is used in the combination of one embodiment.

Examples of the release layer 32 include, but are not particularly limited to, various waxes such as silicone wax, silicone resins, silicone-modified resins, fluorine-containing resins, fluorine-modified resins, polyvinyl alcohol, acrylic resins, rosin resins, polyester, polyvinyl acetal, polyester polyol, polyether polyol, urethane polyol, silsesquioxane, and urethane-modified polyester (polyester urethane). Alternatively, the release layer described above about the thermal transfer sheet 10 of one embodiment may be appropriately selected and used.

A preferred form of the release layer 32 contains silsesquioxane. According to the release layer 32 containing silsesquioxane, the transferability of the transfer layer 40 can be improved, and only the transfer layer 40 in a region having no overlap with the inhibit layer 2 can be accurately transferred onto the transfer receiving article 60 with good foil cutting properties, in cooperation with the inhibit layer 2 transferred onto the transfer layer 40, using the thermal transfer sheet 10 of one embodiment. Furthermore, a lack of transfer of the transfer layer 40 can be sufficiently prevented. Particularly, when the transfer layer 40 comprises protective layer 36 (also referred to as a peel layer), foil cutting properties upon transfer of the transfer layer 40 comprising the protective layer 36 tends to be low. Nonetheless, the foil cutting properties of the transfer layer 40, even comprising the protective layer 36, can be favorable by establishing the release layer 32 containing silsesquioxane between the support 31 and the transfer layer 40. The release layer 32 containing silsesquioxane is suitable when the transfer layer 40 comprises protective layer 36 and this protective layer 36 contains a cured product of an active ray-curable resin. In summary, the release layer 32 containing silsesquioxane is particularly suitable for a configuration having the transfer layer 40 comprising robust protective layer 36.

The silsesquioxane described in the present specification is a siloxane compound having a Si—O bond in the backbone chain (formula 1 given below) and means a siloxane compound having 1.5 oxygen atoms in unit composition. The silsesquioxane also includes compounds having various functional groups introduced in organic group R in the following formula 1.

$$(RSiO_{0.5})_n \qquad \text{(formula 1)}$$

wherein R is an organic group.

Examples of the backbone structure of the silsesquioxane include various backbone structures such as random type, cage type, and ladder type. Any of the backbone structures may be used. Among them, silsesquioxane having a random type or cage type backbone structure is preferred, and random type is particularly preferred.

Whether or not the release layer 32 contains silsesquioxane can be determined by the following method.

Measurement Method:

$^{29}$Si cross polarization (CP)/magic-angle spinning (MAS) NMR

Measurement Conditions:

Apparatus name: BRUKER nuclear magnetic resonance apparatus (NMR) AVANCE III HD

Resonance frequency: 79.51 MHz

Repetition time: 4 sec.

Contact time: 3 msec.

The number of sample rotations: 5 kHz

Specifically, a sample is prepared from the target intermediate transfer medium by scraping off the release layer. When this sample is measured using the measurement method and the measurement conditions described above, the silsesquioxane can be identified on the basis of whether or not a peak of a silsesquioxane-derived T component described below which appears at chemical shifts from −45 ppm to −70 ppm can be confirmed. Since a peak derived from silica ($SiO_2$) appears at chemical shifts from −80 to −110 ppm, this permits clear distinction between silica and silsesquioxane as the component contained in the release layer. FIGS. 11A and 11B each show one example of measurement results when the release layer containing silsesquioxane is measured by the measurement method described above.

[Formula 1]

The release layer 32 may contain, as the silsesquioxane, a reaction product of silsesquioxane having one functional group with a resin having another functional group reactable with the one functional group. The release layer 32 may contain one silsesquioxane or may contain two or more silsesquioxanes.

A preferred form of the release layer 32 contains a reaction product of a resin having a carboxyl group with silsesquioxane having a functional group reactable with the carboxyl group. The preferred form of the release layer 32 can impart solvent resistance to the release layer 32.

Examples of the silsesquioxane reactable with the resin having a carboxyl group include silsesquioxane having an epoxy group. In addition, for example, silsesquioxane having a hydroxy group, an amino group, or a mercapto group may be used.

Examples of the resin having a carboxyl group include acrylic polymers. Examples of the acrylic polymer include (meth)acrylic acid polymers or derivatives thereof, (meth) acrylic acid ester polymers or derivatives thereof, copolymers of (meth)acrylic acid and other monomers or derivatives thereof, and copolymers of (meth)acrylic acid ester and other monomers or derivatives thereof. In addition, examples of the resin having a carboxyl group include polyester, polyurethane, silicone resins, and rosin resins.

The reaction product of silsesquioxane having one functional group with a resin having another functional group reactable with the one functional group can be obtained using a reaction catalyst or the like. The reaction catalyst can be appropriately determined according to the functional group of the silsesquioxane, or the functional group of the optionally contained resin reactable with the silsesquioxane. Examples of the reaction catalyst for obtaining a reaction product containing silsesquioxane having an epoxy group and a resin having a carboxyl group include organometal compounds (including chelate (complexes) of organometal compounds).

A more preferred form of the release layer 32 contains a reaction product of silsesquioxane having an epoxy group with a resin containing a carboxyl group and having an acid value of 10 mg KOH/g or higher. According to the release layer containing this reaction product, solvent resistance to be imparted to the release layer 32 can be further improved. The acid value described in the specification of the present application means the number of milligrams of potassium hydroxide necessary for neutralizing an acid component (e.g., a carboxyl group) contained in 1 g of a polymer, and can be measured by a method conforming to JIS-K-2501 (2003). The upper limit value of a preferred acid value is not particularly limited and is 200 mg KOH/g as one example.

When the release layer 32 contains a reaction product of silsesquioxane having an epoxy group with a resin having a carboxyl group, the mass of the silsesquioxane having an epoxy group as one example, constituting the reaction product is 10% by mass or more and 95% by mass or less, and the mass of the resin having a carboxyl group is 5% by mass or more and 90% by mass or less.

A preferred form of the release layer 32 more preferably contains 75% by mass or more and 95% by mass or less, particularly, 80% by mass or more and 90% by mass or less, of the silsesquioxane (including the reaction product of silsesquioxane having one functional group with a resin having another functional group reactable with the one functional group) with respect to the total mass of the release layer 32.

A further preferred form of the release layer 32 contains a urethane-modified polyester having a glass transition temperature (Tg) of 50° C. or lower, particularly, 20° C. or lower, in addition to the silsesquioxane.

According to the release layer 32 containing the urethane-modified polyester having a glass transition temperature (Tg) of 50° C. or lower in addition to the silsesquioxane, various effects described about the release layer 32 containing the silsesquioxane as well as the peelable property of the release layer 32 can be optimized. Specifically, the transfer layer 40 disposed on the release layer 32 can be transferred with good foil cutting properties only upon application of energy, and the adhesion between the release layer 32 and the transfer layer 40 can be favorable without the application of energy. Thus, according to the release layer 32 containing the urethane-modified polyester having a glass transition temperature (Tg) of 50° C. or lower in addition to the silsesquioxane, unintended dropout of the transfer layer 40 can be suppressed in a state without the application of energy.

The glass transition temperature (Tg) described in the present specification means a temperature determined by DSC (differential scanning calorimetry) in accordance with JIS-K-7121 (2012).

The urethane-modified polyester can be obtained using polyester polyol and an isocyanate type compound. The polyester polyol means a compound having two or more ester bonds and two or more hydroxy groups in the molecule. Examples thereof include condensates of polyhydric alcohols and polybasic carboxylic acids, condensates of hydroxycarboxylic acids and polyhydric alcohols, and compounds obtained by the ring opening of cyclic lactone. Examples of the isocyanate type compound include, but are not particularly limited to, adducts of aromatic isocyanate. Examples of the aromatic polyisocyanate include 2,4-toluene diisocyanate, 2,6-toluene diisocyanate, mixtures of 2,4-toluene diisocyanate and 2,6-toluene diisocyanate, 1,5-naphthalene diisocyanate, tolidine diisocyanate, p-phenylene diisocyanate, trans-cyclohexane-1,4-diisocyanate, xylylene diisocyanate, triphenylmethane triisocyanate, and tris(isocyanatophenyl) thiophosphate. Particularly, 2,4-toluene diisocyanate, 2,6-toluene diisocyanate, or a mixture of 2,4-toluene diisocyanate and 2,6-toluene diisocyanate is preferred.

In the form described above, the content of the silsesquioxane with respect to the total mass of the release layer 32 is preferably 10% by mass or more, more preferably 15% by mass or more. Also, the content of the urethane-modified polyester having a glass transition temperature (Tg) of 50° C. or lower with respect to the total mass of the release layer 32 is preferably 60% by mass or more, more preferably 70% by mass or more. The release layer 32 may one urethane-modified polyester having a glass transition temperature (Tg) of 50° C. or lower or may contain two or more urethane-modified polyesters having a glass transition temperature (Tg) of 50° C. or lower.

The thickness of the release layer 32 is not particularly limited and is preferably 0.3 μm or larger and 2 μm or smaller, more preferably 0.5 μm or larger and 1 μm or smaller.

(Transfer Layer)

Transfer layer 40 is disposed on the support 31 or on the release layer 32 arbitrarily disposed on the support 31. The transfer layer 40 is a layer that is transferred onto the transfer receiving article 60 by the application of energy. The transfer layer 40 corresponding to a region where the inhibit layer 2 is disposed is not transferred onto the transfer receiving article 60.

The transfer layer 40 comprises receiving layer 35 as an essential layer. The receiving layer 35 is positioned as the uppermost layer constituting the transfer layer 40. In other words, among the layers constituting the transfer layer 40, the receiving layer 35 is positioned furthest from the support 31.

(Receiving Layer)

The receiving layer 35 is capable of receiving a sublimable dye and contains a binder resin capable of receiving the sublimable dye. Examples of the binder resin include: polyolefins such as polypropylene; halogenated resins such as polyvinyl chloride and polyvinylidene chloride; vinyl resins such as polyvinyl acetate, vinyl chloride-vinyl acetate copolymers, ethylene-vinyl acetate copolymers, and polyacrylic acid ester; polyesters such as polyethylene terephthalate and polybutylene terephthalate; polystyrene; polyamide; copolymers of olefins such as ethylene or propylene and other vinyl polymers; ionomer and cellulose resins such as cellulose diastase; polycarbonate; acrylic resins; polyvinylpyrrolidone; polyvinyl alcohol; and gelatin. The receiving layer 35 may contain one binder resin and may contain two or more binder resins. The receiving layer 35 may contain any of various heretofore known release agents.

Examples of the heretofore known release agent include: solid waxes such as polyethylene wax, amide wax, and Teflon® powder; fluorine type or phosphoric acid ester type surfactants; various modified silicone oils such as silicone oil, reactive silicone oil, and curable silicone oil; and various silicone resins.

The receiving layer 35 is a layer that comes into contact with the transfer receiving article 60 when the transfer layer 40 is transferred onto the transfer receiving article 60. Thus, if measures to adhesion to the receiving layer 35 are not taken on the transfer receiving article 60 side, it is preferred that the receiving layer 35 should contain a component having an adhesive property. Examples of the component having an adhesive property include the component of the adhesive layer described above.

Use of the thermal transfer sheet 10 having the heat-seal layer as shown in FIG. 4 or 5 as the thermal transfer sheet which is used in the combination of one embodiment can attain favorable adhesion between the transfer receiving article 60 and the transfer layer 40 without imparting an adhesive property to the receiving layer 35. Specifically, the heat-seal layer 8 of the thermal transfer sheet 10 of one embodiment is transferred onto the transfer layer 40 at a stage before transfer of the transfer layer 40 onto the transfer receiving article 60 so that the transfer receiving article 60 and the transfer layer 40 adhere tightly to each other via the heat-seal layer 8. As a result, the adhesion between the transfer receiving article 60 and the transfer layer 40 can be favorable.

The method for forming the receiving layer 35 is not particularly limited. The receiving layer 35 can be formed, for example, by dispersing or dissolving the binder resin and additives, such as a release agent, to be optionally added in an appropriate solvent to prepare a coating liquid for the receiving layer, and coating the substrate 1 or an arbitrary layer constituting the transfer layer 40 disposed on the substrate 1 with the coating liquid, followed by drying. The thickness of the receiving layer 35 is not particularly limited and is preferably 0.1 μm or larger and 10 μm or smaller.

(Protective Layer)

As shown in FIG. 7, the transfer layer 40 may have a layered structure where protective layer 36 and the receiving layer 35 are layered in the presented order from the release layer 32 side. The intermediate transfer medium having the form shown in FIG. 7 can impart durability to a print obtained by transferring the transfer layer 40 onto the transfer receiving article 60.

The protective layer 36 is not particularly limited, and a protective layer heretofore known in the intermediate transfer medium or protective layer transfer sheet field can be appropriately selected and used. Examples of the resin constituting the protective layer 36 include polyester, polystyrene, acrylic resins, polyurethane, acrylic urethane resins, silicone-modified resins of these resins, and mixtures of these resins.

A preferred form of the protective layer 36 contains a cured product of an active ray-curable resin. The preferred form of the protective layer 36 can impart higher durability to a print obtained by transferring the transfer layer 40 onto the transfer receiving article 60.

The configuration of the second inhibit layer 2 containing the cured product of an active ray-curable resin as described about the second form of the inhibit layer 2 in the thermal transfer sheet 10 of one embodiment can be appropriately selected and used for the protective layer 36 containing the cured product of an active ray-curable resin.

A more preferred form of the protective layer 36 contains 5% by mass or more and 80% by mass or less, particularly, 10% by mass or more and 50% by mass or less, of a cured product of urethane (meth)acrylate, particularly, a cured product of polyfunctional urethane (meth)acrylate, as the cured product of an active ray-curable resin described about the second form of the inhibit layer 2 in the thermal transfer sheet 10 of one embodiment, with respect to the total mass of the protective layer 36.

From the viewpoint of achieving both the solvent resistance and the flexibility of the protective layer, the protective layer 36 preferably contains a cured product of (i) polyfunctional urethane (meth)acrylate having 5 or more and 15 or less functional groups, particularly, 6 or more and 15 or less functional groups, and (ii) any one, or both, of polyfunctional urethane (meth)acrylate having 2 or more and 4 or less functional groups, and (meth)acrylate having 2 or more and 5 or less functional groups. Also, the protective layer 36 preferably contains (iii) a cured product of polyfunctional urethane (meth)acrylate having 5 or more and 15 or less functional groups, particularly, 6 or more and 15 or less functional groups, and (iv) any one, or both, of a cured product of polyfunctional urethane (meth)acrylate having 2 or more and 4 or less functional groups, and a cured product of (meth)acrylate having 2 or more and 5 or less functional groups. The content of a component derived from (ii) the polyfunctional urethane (meth)acrylate having 2 or more and 4 or less functional groups, and the (meth)acrylate having 2 or more and 5 or less functional groups is preferably 5% by mass or more and 80% by mass or less, more preferably 10% by mass or more and 70% by mass or less, with respect to the total mass of the protective layer 36. The same holds true for the content of (iv) the cured product of polyfunctional urethane (meth)acrylate having 2 or more and 4 or less functional groups, and the cured product of (meth)acrylate having 2 or more and 5 or less functional groups. For the purpose of further improving foil cutting properties, the weight average molecular weight of the (meth)acrylate having 2 or more and 5 or less functional groups is preferably 200 or larger and 5000 or smaller.

When the protective layer 36 contains a cured product of an active ray-curable resin containing an unsaturated bond-containing acrylic copolymer, the unsaturated bond-containing acrylic copolymer serving as a polymerizable component preferably has an acid value of 5 mg KOH/g or higher and 500 mg KOH/g or lower, more preferably 10 mg KOH/g or higher and 150 mg KOH/g or lower. Use of the unsaturated bond-containing acrylic copolymer having its acid value that falls within the preferred range described above can enhance the surface strength of the protective layer 36. The acid value of the polymer can be appropriately adjusted by adjusting the ratios of the monomer components constituting the polymer.

The unsaturated bond-containing acrylic copolymer preferably has a weight average molecular weight of 3000 or larger and 100000 or smaller, more preferably 10000 or larger and 80000 or smaller. Use of the unsaturated bond-containing acrylic copolymer having a weight average molecular weight that falls within the range described above can impart higher chemical durability including heat resistance and chemical resistance and physical durability including scratch strength to the protective layer 36. Furthermore, gelling reaction can be suppressed during preservation of a coating liquid for the protective layer for forming the protective layer, and the preservation stability of the coating liquid for the protective layer can be improved.

The unsaturated bond-containing acrylic copolymer is preferably contained at 10% by mass or more and 80% by mass or less, more preferably 20% by mass or more and 70% by mass or less, further preferably 20% by mass or more and 50% by mass or less, in the active ray-curable resin.

In the intermediate transfer medium 50 having the form shown in FIG. 6 or 7, an anchor layer may be disposed between the support 31 and the release layer 32. Examples of the material of the anchor layer include polyurethane, phenol resins, and epoxy resins. Alternatively, the configuration of the dye primer layer described about the thermal transfer sheet of one embodiment can be appropriately selected and used.

In the intermediate transfer medium 50 having the form shown in FIG. 7, a primer layer may be disposed between the protective layer 36 and the receiving layer 35. Examples of the material of the primer layer include polyester, vinyl chloride-vinyl acetate copolymers, polyurethane, polyamide, epoxy resins, phenol resins, polyvinyl chloride, polyvinyl acetate, acid-modified polyolefin, copolymers of ethylene and vinyl acetate or acrylic acid, (meth)acrylic resins, polyvinyl alcohol, polyvinyl acetal, polybutadiene, and rubber type compounds. The primer layer may be formed using any of various curing agents, for example, an isocyanate type curing agent, in addition to each resin described above. Alternatively, the configuration of the dye primer layer described about the thermal transfer sheet of one embodiment can be appropriately selected and used.

A back face layer may be disposed on a surface of the support 31 on a side opposite to the surface on which the release layer 32 is disposed.

<<Method for Producing Print<<

Next, the method for producing a print according to an embodiment of the present disclosure (hereinafter, referred to as the production method of one embodiment) will be described. The production method of one embodiment is a method for producing a print using the combination of one embodiment described above, the method comprising: the step of forming thermal transfer image 70 on the transfer layer 40 of the intermediate transfer medium 50 (see FIG. 8A); a first transfer step of transferring the inhibit layer 2 of the thermal transfer sheet onto a part of the transfer layer 40 with the thermal transfer image 70 formed thereon (see FIG. 8B); and a second transfer step of transferring the transfer layer 40 of the intermediate transfer medium 50 onto transfer receiving article 60 (see FIG. 8C), wherein the second transfer step is the step of using the inhibit layer 2 transferred onto a part of the transfer layer 40 as a masking member, and transferring only the transfer layer 40 in a region having no overlap with the inhibit layer 2 in the transfer layer 40 corresponding to a region to which energy has been applied onto the transfer receiving article 60.

According to the production method of one embodiment, print 100 can be produced by accurately transferring only the transfer layer of the intermediate transfer medium desired to be transferred onto the transfer receiving article (see FIG. 8D). Hereinafter, each step of the production method of one embodiment will be described. The thermal transfer sheet and the intermediate transfer medium described about the combination of one embodiment can be appropriately selected and used as the thermal transfer sheet and the intermediate transfer medium which are used in the production method of one embodiment. Thus, detailed description about these constituents will be omitted here.

(Step of Forming Thermal Transfer Image)

This step is, as shown in FIG. 8A, the step of forming thermal transfer image 70 on the transfer layer 40 of the intermediate transfer medium 50. The formation of the thermal transfer image 70 may be performed using a heretofore known thermal transfer sheet having a dye layer, or may be performed using the thermal transfer sheet 10 of one embodiment shown in FIG. 3, 5, etc. in which the inhibit layer 2 and the dye layer 7 are disposed as being frame sequentially.

In the form shown in the drawing, an intermediate transfer medium having the form shown in FIG. 6 is used as the intermediate transfer medium 50. However, the intermediate transfer medium is not limited by this configuration.

In the form shown in the drawing, the thermal transfer image 70 is formed on a part of the transfer layer 40 of the intermediate transfer medium 50, i.e., on a part of the receiving layer 35. However, the thermal transfer image 70 may be formed on the whole face of the transfer layer 40. That is, the formation region of the thermal transfer image 70 is not limited by any means. The formation of the thermal transfer image 70 can be performed using, for example, a printer having a thermal head or the like.

(First Transfer Step)

This step is, as shown in FIG. 8B, the step of superposing the intermediate transfer medium 50 on the thermal transfer sheet 10, applying energy to the back face side of the thermal transfer sheet 10 (in the form shown in FIG. 8B, the upper face of the thermal transfer sheet 10) with a heating member such as a thermal head (not shown), and transferring the inhibit layer 2 of the thermal transfer sheet 10 corresponding to a region to which energy has been applied (see the energy application region of FIG. 8B) onto a part of the transfer layer 40 of the intermediate transfer medium 50.

Through this step, the inhibit layer 2 is transferred onto a part of the transfer layer 40 of the intermediate transfer medium 50.

The transfer region of the inhibit layer 2 is not particularly limited. The inhibit layer 2 may be transferred onto a region with no thermal transfer image 70 formed thereon, of the transfer layer 40, as shown in the drawing, may be transferred only onto a region with the thermal transfer image 70 formed thereon, or may be transferred onto both the region with no thermal transfer image 70 formed thereon and the region with the thermal transfer image 70 formed thereon (in the form shown in FIG. 8B, one inhibit layer 2 is transferred onto a region with no thermal transfer image 70 formed thereon). One inhibit layer 2 may be transferred so as to span the region with the thermal transfer image 70 formed thereon and the region with no thermal transfer image 70 formed thereon. Alternatively, a plurality of inhibit layers 2 may be transferred at a predetermined interval onto the same surface of the transfer layer 40 (not shown). That is, the transfer region of the inhibit layer 2 is not limited by any means as long as the condition of a part of the transfer layer 40 is satisfied.

Figure 9:
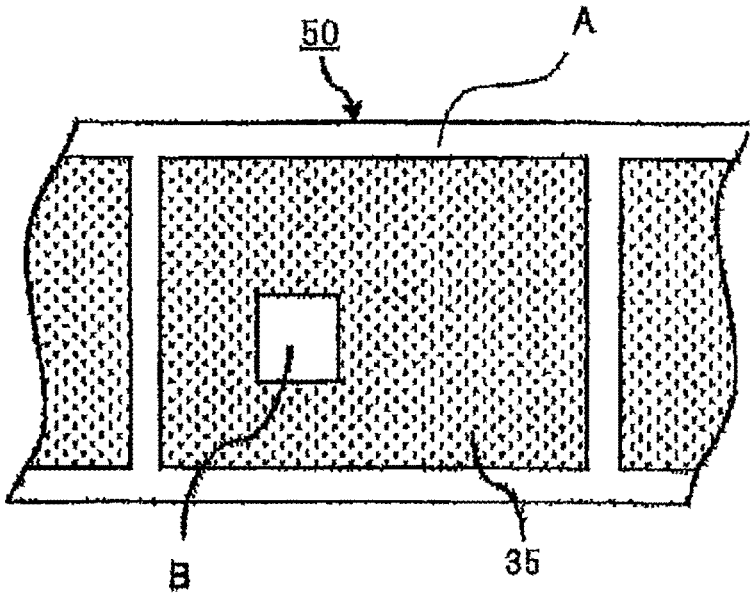
FIG. 9 is a schematic plane view of an intermediate transfer medium showing one example of a transfer region of an inhibit layer.

FIG. 9 is a schematic plane view of the intermediate transfer medium showing one example of the transfer region of the inhibit layer 2. The open regions (represented by symbols A and B in the drawing) each depict a region where the inhibit layer 2 of the thermal transfer sheet 10 has been transferred. One example of the transfer region of the inhibit layer 2 includes peripheral edges of the transfer layer 40 to be transferred onto a transfer receiving article, as indicated by symbol A of FIG. 9. Another example thereof includes a region allocated for an ancillary product such as an IC chip and a signature portion in the transfer receiving article 60 onto which the transfer layer 40 is finally transferred, i.e., a region where a disadvantage will be caused if the transfer layer 40 remains on the transfer receiving article after transfer of the transfer layer 40, as indicated by symbol B of FIG. 9.

The transfer of the inhibit layer 2 can be performed using, for example, a printer having a thermal head or the like, a heat roll method, or a hot stamping method.

(Second Transfer Step)

This step is the step of transferring the transfer layer 40 of the intermediate transfer medium 50 onto the transfer receiving article 60. Specifically, this step is the step of superposing the transfer layer 40 of the intermediate transfer medium 50 with the inhibit layer 2 transferred thereon on a transfer receiving article, applying energy to the back face side of the intermediate transfer medium 50 (in the form shown in FIG. 8C, the upper face of the intermediate transfer medium 50), and transferring the transfer layer 40 corresponding to a region to which energy has been applied (see the energy application region of FIG. 8C) onto the transfer receiving article 60. In this respect, the inhibit layer 2 transferred onto the transfer layer 40 of the intermediate transfer medium 50 plays a role as a masking member. As shown in FIGS. 8C and 8D, in the transfer layer 40 corresponding to the region to which energy has been applied, only the transfer layer 40 in a region having no overlap with the inhibit layer 2 is transferred onto the transfer receiving article 60 so that print 100 can be produced in a form as shown in FIG. 8D.

In the production method of one embodiment, the transfer of the inhibit layer 2 is performed using a thermal transfer sheet comprising the first form or the second form of the inhibit layer described above as the thermal transfer sheet. Therefore, in the transfer layer 40 corresponding to the region to which energy has been applied, only the transfer layer 40 in a region having no overlap with the inhibit layer 2 can be accurately transferred with good foil cutting properties when the transfer layer 40 of the intermediate transfer medium 50 with the inhibit layer 2 transferred thereon is transferred onto the transfer receiving article 60. Furthermore, a lack of transfer of the transfer layer can be prevented.

The energy application region is not particularly limited, and energy can be applied to a region desired to be transferred onto the transfer receiving article 60. The transfer of the transfer layer 40 of the intermediate transfer medium 50 can be performed using, for example, a printer having a thermal head or the like, a heat roll method, or a hot stamping method.

Examples of the transfer receiving article 60 can include, but are not particularly limited to, plain paper, high-quality paper, tracing paper, wood, resin plates (including cards and films) of polycarbonate, acrylic resins, acrylonitrile-butadiene-styrene (ABS) resins, polyvinyl chloride, vinyl chloride-vinyl acetate copolymers, or the like, metal (e.g., aluminum) plates, glass plates, and ceramic (e.g., pottery) plates. Alternatively, transfer receiving article 60 having a curvature may be used.

In order to improve the adhesion between the transfer receiving article 60 and the transfer layer 40, the second transfer step may comprise the step of transferring a heat-seal layer onto the transfer layer 40 in advance. The step of transferring a heat-seal layer may be performed using the thermal transfer sheet of one embodiment having the heat-seal layer 8 as shown in FIG. 4 or 5, or may be performed using a heretofore known thermal transfer sheet having a heat-seal layer.

The transfer region of the heat-seal layer 8 is not particularly limited. The heat-seal layer 8 may be transferred onto the whole face of the transfer layer 40, may be transferred onto the transfer layer 40 in a region to which the energy is applied, or may be selectively transferred onto the transfer layer 40 in a region having no overlap with the inhibit layer 2 in the region to which the energy is applied (see FIG. 10A). In the case of transferring the heat-seal layer 8 onto the inhibit layer 2, the heat-seal layer 8 to be transferred onto the inhibit layer 2 should be prevented from being transferred onto the transfer receiving article 60. For this purpose, the heat-seal layer can be selected such that the adhesive property of the heat-seal layer to the inhibit layer 2 is higher than that of the heat-seal layer 8 to the transfer receiving article 60.

Before the first transfer step, the heat-seal layer 8 may be transferred onto the transfer layer 40 of the intermediate transfer medium 50, and after this transfer of the heat-seal layer 8, the inhibit layer 2 may be transferred thereonto. In this case, the transfer of the heat-seal layer 8 may be performed to the whole face of the transfer layer 40 (see FIG. 10B), may be selectively performed to a region to which energy is applied, or may be selectively performed onto the transfer layer 40 excluding a region planned for the transfer of the inhibit layer 2 in the region to which energy is applied.

The thermal transfer sheet of one embodiment which is used in combination with an intermediate transfer medium, the combination of a thermal transfer sheet and an intermediate transfer medium, and the method for producing a print are described above with a focus on the case where the intermediate transfer medium is an intermediate transfer medium in which release layer 32 is disposed between support 31 and transfer layer 40. The release layer 32 is not necessarily required to be disposed between the support 31 and the transfer layer 40 when a layer positioned nearest the support 31 among the layers constituting the transfer layer 40 has a release property (peelable property). For example, transfer layer 40 having a layered structure where a protective layer and a receiving layer are arranged in the presented order from the support 31 side can be peeled from the support 31, without establishing the release layer 32, by imparting a peelable property to the protective layer.

Although the method for producing a print of one embodiment has the step of forming thermal transfer image 70 on the transfer layer 40 of the intermediate transfer medium 50, an intermediate transfer medium with the thermal transfer image 70 formed thereon in advance may be used as the intermediate transfer medium. This holds true for the thermal transfer sheet which is used in combination with an intermediate transfer medium, and the combination of a thermal transfer sheet and an intermediate transfer medium.

<<Thermal Transfer Printer<<

Next, the thermal transfer printer according to an embodiment of the present disclosure (hereinafter, referred to as the printer of one embodiment) will be described. The printer of one embodiment is a printer which is used in the combination of a thermal transfer sheet and an intermediate transfer medium, or the method for producing a print of one embodiment, and has an energy application device.

Specifically, the printer of one embodiment has an energy application device (not shown) capable of executing the formation of the thermal transfer image 70 on the transfer layer 40, the transfer of the inhibit layer 2, and the transfer of the transfer layer 40 with the inhibit layer 2 transferred thereon onto the transfer receiving article 60 as described in the production method of one embodiment.

The thermal transfer printer may have one energy application device or two or more energy application devices. For example, the formation of the thermal transfer image 70 on the transfer layer 40, the transfer of the inhibit layer 2, and the transfer of the transfer layer 40 onto the transfer receiving article 60 may be performed using one energy application device or may be performed with independent energy application devices, respectively.

EXAMPLES

Next, the present invention will be described further specifically with reference to Examples and Comparative Examples. Hereinafter, the term "part" or "%" is based on mass unless otherwise specified. The content of each component in the composition of each coating liquid is a solid content (excluding solvents).

Example 1

A PET (polyethylene terephthalate) film having a thickness of 4.5 μm was used as a substrate. One surface of this substrate was coated with a coating liquid for the primer layer having the composition described below such that the dry film thickness was 0.2 μm, followed by drying to form the primer layer. This primer layer was coated with a coating liquid for the yellow dye layer, a coating liquid for the magenta dye layer, and a coating liquid for the cyan dye layer having the composition described below such that the dry film thickness was 0.7 μm, followed by drying to form a dye layer in which the yellow dye layer, the magenta dye layer, and the cyan dye layer were disposed as being frame sequentially. The one surface of the substrate was coated with coating liquid 1 for the inhibit layer having the composition described below such that the inhibit layer and the dye layer were disposed as being frame sequentially, and the dry film thickness was 0.5 μm, followed by drying to form the inhibit layer. This inhibit layer was coated with coating liquid 1 for the adhesive layer having the composition described below such that the dry film thickness was 1 μm, followed by drying to form the adhesive layer. In this way, a thermal transfer sheet having the form shown in FIG. 3 was obtained so as to have a configuration in which: the dye layer was configured such that the yellow dye layer, the magenta dye layer, and the cyan dye layer were arranged in the presented order; and the adhesive layer was disposed on the inhibit layer. Also, the primer layer was disposed between the substrate and the yellow dye layer, the magenta dye layer, and the cyan dye layer.

(Coating Liquid for Primer Layer)

| | |
|---|---|
| Alumina sol<br>(Alumina Sol 200, Nissan Chemical Corp.) | 2.5 parts |
| Polyvinylpyrrolidone<br>(PVP K-60, ISP Information System Products Co., Ltd.) | 2.5 parts |
| Water | 47.5 parts |
| Isopropyl alcohol | 47.5 parts |

(Coating Liquid for Yellow Colorant Layer)

| | |
|---|---|
| Solvent yellow 93 | 6 parts |
| Polyvinyl acetal<br>(S-LEC(R) KS-5, Sekisui Chemical Co., Ltd.) | 5 parts |
| Toluene | 50 parts |
| Methyl ethyl ketone | 50 parts |

(Coating Liquid for Magenta Colorant Layer)

| | |
|---|---|
| Disperse red 60 | 3 parts |
| Disperse violet 26 | 4 parts |
| Polyvinyl acetal<br>(S-LEC(R) KS-5, Sekisui Chemical Co., Ltd.) | 5 parts |
| Toluene | 50 parts |
| Methyl ethyl ketone | 50 parts |

(Coating Liquid for Cyan Colorant Layer)

| | |
|---|---|
| Solvent blue 63 | 4 parts |
| Disperse blue 354 | 4 parts |
| Polyvinyl acetal<br>(S-LEC(R) KS-5, Sekisui Chemical Co., Ltd.) | 5 parts |
| Toluene | 50 parts |
| Methyl ethyl ketone | 50 parts |

(Coating Liquid 1 for Inhibit Layer)

| | |
|---|---|
| Polyethylene wax (solid content: 35%)<br>(WE63-284, Konishi Co., Ltd.) | 4.7 parts |
| Carnauba wax (solid content: 40%)<br>(WE95, Konishi Co., Ltd.) | 5.4 parts |
| Styrene butadiene rubber (solid content: 39%)<br>(LX430, Zeon Corp.) | 1.2 parts |
| Isopropyl alcohol | 10 parts |
| Water | 10 parts |

(Coating Liquid 1 for Adhesive Layer)

| | |
|---|---|
| Polyester<br>(Elitel(R) UE3350, Unitika Ltd.) | 10 parts |
| Polyester<br>(Elitel(R) UE3380, Unitika Ltd.) | 10 parts |
| Methyl ethyl ketone | 40 parts |
| Toluene | 40 parts |

Example 2

A thermal transfer sheet of Example 2 was obtained in the same way as in Example 1 except that: in the thermal transfer sheet of Example 1, the dye layer, the inhibit layer, and the heat-seal layer were disordered as being frame sequentially; and one surface of the substrate was coated with coating liquid 1 for the heat-seal layer having the composition described below such that the dry film thickness was 1 μm, followed by drying to form the heat-seal layer. The thermal transfer sheet of Example 2 having the form shown in FIG. 5A assumed a configuration in which: the dye layer was configured such that the yellow dye layer, the magenta dye layer, and the cyan dye layer were arranged in the presented order; and the adhesive layer was disposed on the inhibit layer. Also, the primer layer was disposed between the substrate and the yellow dye layer, the magenta dye layer, and the cyan dye layer.

(Coating Liquid 1 for Heat-Seal Layer)

| | |
|---|---|
| Polyester (Elitel(R) UE3380, Unitika Ltd.) | 10 parts |
| Methyl ethyl ketone | 20 parts |
| Toluene | 20 parts |

Example 3

A thermal transfer sheet of Example 3 was obtained in the same way as in Example 2 except that the coating liquid 1 for the heat-seal layer was changed to coating liquid 2 for the heat-seal layer having the composition described below to form the heat-seal layer.

(Coating Liquid 2 for Heat-Seal Layer)

| | |
|---|---|
| Vinyl chloride-vinyl acetate copolymer (SOLBIN(R) CNL, Nissin Chemical Co., Ltd.) | 20 parts |
| Methyl ethyl ketone | 20 parts |
| Toluene | 20 parts |

Example 4

A thermal transfer sheet of Example 4 was obtained in the same way as in Example 1 except that the coating liquid 1 for the inhibit layer was changed to coating liquid 2 for the inhibit layer having the composition described below to form the inhibit layer.

(Coating Liquid 2 for Inhibit Layer)

| | |
|---|---|
| Carnauba wax (solid content: 40%) (WE95, Konishi Co., Ltd.) | 20 parts |
| Isopropyl alcohol | 40 parts |
| Water | 40 parts |

Example 5

A thermal transfer sheet of Example 5 was obtained in the same way as in Example 1 except that the coating liquid 1 for the inhibit layer was changed to coating liquid 3 for the inhibit layer having the composition described below to form the inhibit layer.

(Coating Liquid 3 for Inhibit Layer)

| | |
|---|---|
| Epoxy group-containing silicone-modified acrylic resin (solid content: 50%) (CELTOP(R) 226, Daicel Corp.) | 8 parts |
| Curing catalyst (solid content: 50%) (CELTOP(R) CAT-A, Daicel Corp.) | 1.5 parts |
| Toluene | 20 parts |
| Methyl ethyl ketone | 20 parts |

Example 6

A thermal transfer sheet of Example 6 was obtained in the same way as in Example 2 except that the coating liquid 1 for the inhibit layer was changed to coating liquid 3 for the inhibit layer having the composition described above to form the inhibit layer.

Example 7

A thermal transfer sheet of Example 7 was obtained in the same way as in Example 2 except that: the coating liquid 1 for the inhibit layer was changed to coating liquid 3 for the inhibit layer having the composition described above to form the inhibit layer; and the coating liquid 1 for the heat-seal layer was changed to coating liquid 2 for the heat-seal layer having the composition described above to form the heat-seal layer.

Example 8

A thermal transfer sheet of Example 8 was obtained in the same way as in Example 1 except that the coating liquid 1 for the inhibit layer was changed to coating liquid 4 for the inhibit layer having the composition described below to form the inhibit layer.

(Coating Liquid 4 for Inhibit Layer)

| | |
|---|---|
| Polyfunctional acrylate (NK Ester A-9300, Shin-Nakamura Chemical Co., Ltd.) | 20 parts |
| Urethane acrylate (NK Oligomer EA1020 Bifunctional, Shin-Nakamura Chemical Co., Ltd.) | 20 parts |
| Urethane acrylate (NK Ester U-15HA Pentadecafunctional, Shin-Nakamura Chemical Co., Ltd.) | 10 parts |
| Reactive binder (unsaturated group-containing) (NK Polymer C241, Shin-Nakamura Chemical Co., Ltd.) | 5 parts |
| Photo-polymerization initiator (Irgacure(R) 907, BASF Japan Ltd.) | 5 parts |
| Filler (MEK-AC2140, average particle size: 12 nm, Nissan Chemical Corp.) | 40 parts |
| Toluene | 200 parts |
| Methyl ethyl ketone | 200 parts |

Example 9

A thermal transfer sheet of Example 9 was obtained in the same way as in Example 2 except that the coating liquid 1 for the inhibit layer was changed to coating liquid 4 for the inhibit layer having the composition described above to form the inhibit layer.

Example 10

A thermal transfer sheet of Example 10 was obtained in the same way as in Example 2 except that: the coating liquid 1 for the inhibit layer was changed to coating liquid 4 for the inhibit layer having the composition described above to form the inhibit layer; and the coating liquid 1 for the heat-seal layer was changed to coating liquid 2 for the heat-seal layer having the composition described above to form the heat-seal layer.

Example 11

A thermal transfer sheet of Example 11 was obtained in the same way as in Example 1 except that the coating liquid 1 for the inhibit layer was changed to coating liquid 5 for the inhibit layer having the composition described below to form the inhibit layer.

(Coating Liquid 5 for Inhibit Layer)

| | |
|---|---|
| Polyvinyl butyral (S-LEC(R) BX-1, Sekisui Chemical Co., Ltd.) | 10 parts |
| Polyisocyanate curing agent (Takenate(R) D218, Mitsui Chemicals, Inc.) | 2 parts |
| Phosphoric acid ester (PLYSURF(R) A208S, DKS Co. Ltd.) | 2 parts |
| Methyl ethyl ketone | 43 parts |
| Toluene | 43 parts |

Example 12

A thermal transfer sheet of Example 12 was obtained in the same way as in Example 2 except that the coating liquid 1 for the inhibit layer was changed to coating liquid 5 for the inhibit layer having the composition described above to form the inhibit layer.

Example 13

A thermal transfer sheet of Example 13 was obtained in the same way as in Example 2 except that: the coating liquid 1 for the inhibit layer was changed to coating liquid 5 for the inhibit layer having the composition described above to form the inhibit layer; and the coating liquid 1 for the heat-seal layer was changed to coating liquid 2 for the heat-seal layer having the composition described above to form the heat-seal layer.

Comparative Example 1

A thermal transfer sheet of Comparative Example 1 was obtained in the same way as in Example 1 except that the coating liquid 1 for the inhibit layer was changed to coating liquid A for the inhibit layer having the composition described below to form the inhibit layer.

(Coating Liquid A for Inhibit Layer)

| | |
|---|---|
| Polyethylene wax (solid content: 35%) (WE63-284, Konishi Co., Ltd.) | 20 parts |
| Isopropyl alcohol | 40 parts |
| Water | 40 parts |

Comparative Example 2

A thermal transfer sheet of Comparative Example 2 was obtained in the same way as in Example 1 except that the coating liquid 1 for the inhibit layer was changed to coating liquid B for the inhibit layer having the composition described below to form the inhibit layer.

(Coating Liquid B for Inhibit Layer)

| | |
|---|---|
| Vinyl chloride-vinyl acetate copolymer (SOLBIN(R) CNL, Nissin Chemical Co., Ltd.) | 20 parts |
| Methyl ethyl ketone | 20 parts |
| Toluene | 20 parts |

Comparative Example 3

A thermal transfer sheet of Comparative Example 3 was obtained in the same way as in Example 2 except that the coating liquid 1 for the inhibit layer was changed to coating liquid A for the inhibit layer having the composition described above to form the inhibit layer.

Comparative Example 4

A thermal transfer sheet of Comparative Example 4 was obtained in the same way as in Example 2 except that the coating liquid 1 for the inhibit layer was changed to coating liquid B for the inhibit layer having the composition described above to form the inhibit layer.

(Preparation of Intermediate Transfer Medium 1)

A PET film having a thickness of 16 μm was used as a support. The support was coated with a coating liquid for the peel layer having the composition described below such that the dry film thickness was 0.5 μm, followed by drying to form the peel layer. Subsequently, the peel layer was coated with coating liquid 1 for the protective layer having the composition described below such that the dry film thickness was 1 μm, followed by drying to form the protective layer. The protective layer was further coated with a coating liquid for the receiving layer having the composition described below such that the dry film thickness was 1 followed by drying to form the receiving layer. In this way, intermediate transfer medium 1 was obtained such that the peel layer, the protective layer, and the receiving layer were layered in the presented order on the support. In the intermediate transfer medium 1, the peel layer, the protective layer, and the receiving layer constituted the transfer layer.

<Coating Liquid for Peel Layer>

| | |
|---|---|
| Acrylic resin (Dianal(R) BR-87, Mitsubishi Chemical Corp.) | 20 parts |
| Polyester (VYLON(R) 600, Toyobo Co., Ltd.) | 1 part |
| Methyl ethyl ketone | 79 parts |

<Coating Liquid 1 for Protective Layer>

| | |
|---|---|
| Styrene-acrylic copolymer (MUTICLE(R) P5320P, Mitsui Chemicals, Inc.) | 15 parts |
| Polyvinyl alcohol (C-318, DNP Fine Chemicals Co., Ltd.) | 10 parts |
| Water | 3.5 parts |
| Ethanol | 3.5 parts |

<Coating Liquid for Receiving Layer>

| | |
|---|---|
| Vinyl chloride-vinyl acetate copolymer (SOLBIN(R) CNL, Nissin Chemical Co., Ltd.) | 20 parts |
| Epoxy-modified silicone oil (KP-1800U, Shin-Etsu Chemical Co., Ltd.) | 1 part |
| Methyl ethyl ketone | 200 parts |
| Toluene | 200 parts |

(Preparation of Intermediate Transfer Medium 2)

A PET film having a thickness of 16 μm was used as a support. The support was coated with a coating liquid for the anchor layer having the composition described below such that the dry film thickness was 0.3 μm, followed by drying to form the anchor layer. Subsequently, the anchor layer was coated with coating liquid 1 for the release layer having the composition described below such that the dry film thickness was 0.5 μm, followed by drying to form the release layer. Subsequently, the release layer was coated with coating liquid 1 for the protection layer having the composition described above such that the dry film thickness was 1.5 μm, followed by drying to form the protective layer. Subsequently, the protective layer was coated with a coating liquid for the intermediate layer having the composition described below such that the dry film thickness was 0.8 μm, followed by drying to form the intermediate layer. The intermediate layer was coated with a coating liquid for the receiving layer having the composition described above such that the dry film thickness was 1.5 μm, followed by drying to form the receiving layer. In this way, intermediate transfer medium 2 was obtained such that the anchor layer, the release layer, the protective layer, the intermediate layer, and the receiving layer were layered in the presented order on the support. In the intermediate transfer medium 2, the protective layer, the intermediate layer, and the receiving layer constituted the transfer layer.

<Coating Liquid for Anchor Layer>

| | |
|---|---|
| Polyurethane (solid content: 35%) (AP-40N, DIC Corp.) | 7.2 parts |
| Epoxy type curing agent (WATERSOL(R) WSA-950, DIC Corp.) | 0.5 parts |
| Solvent (SOLMIX(R) A-11, Nippon Alcohol Hanbai K.K.) | 9.8 parts |
| Water | 2.4 parts |

<Coating Liquid 1 for Release Layer>

| | |
|---|---|
| Epoxy group-containing silsesguioxane (solid content: 72.6%) (SQ502-8, Arakawa Chemical Industries, Ltd.) | 5.8 parts |
| Aluminum catalyst (solid content: 10%) (CELTOP(R) CAT-A, Daicel Corp.) | 3.8 parts |
| Toluene | 3.5 parts |
| Methyl ethyl ketone | 6.9 parts |

<Coating Liquid for Intermediate Layer>

| | |
|---|---|
| Polyester (VYLON(R) 200, Toyobo Co., Ltd.) | 3.3 parts |
| Vinyl chloride-vinyl acetate copolymer (SOLBIN(R) CNL, Nissin Chemical Co., Ltd.) | 2.7 parts |
| Isocyanate curing agent (Takenate(R), Mitsui Chemicals, Inc.) | 1.5 parts |
| Methyl ethyl ketone | 6.7 parts |
| Toluene | 3.3 parts |

(Preparation of Intermediate Transfer Medium 3)

Intermediate transfer medium 3 was obtained in the same way as in the intermediate transfer medium 2 except that: the coating liquid 1 for the release layer was changed to coating liquid 2 for the release layer having the composition described below to form the release layer; the coating liquid 1 for the protective layer was changed to coating liquid 2 for the protective layer having the composition described below; and after coating with the coating liquid for the protective layer and drying, light exposure was performed using a UV light exposure machine to form the protective layer. The intermediate transfer medium 3 was an intermediate transfer medium that had higher strength of the protective layer and was more susceptible to tailing or a lack of transfer when the transfer layer with the inhibit layer transferred thereon was transferred onto the transfer receiving article, as compared with the intermediate transfer medium 1 or 2.

<Coating Liquid 2 for Release Layer>

| | |
|---|---|
| Epoxy group-containing silsesquioxane (solid content: 72.6%) (SQ502-8, Arakawa Chemical Industries, Ltd.) | 1.1 parts |
| Urethane-modified polyester (solid content: 40%) (VYLON(R) UR-3500, Toyobo Co., Ltd.) | 8.2 parts |
| Zirconia catalyst (solid content: 45%) (ZC-540, Matsumoto Fine Chemical Co., Ltd.) | 1.1 parts |
| Acetylacetone | 3.1 parts |
| Toluene | 2.2 parts |
| Methyl ethyl ketone | 4.3 parts |

<Coating Liquid 2 for Protective Layer>

| | |
|---|---|
| Trifunctional acrylate (NK Ester A-9300, Shin-Nakamura Chemical Co., Ltd.) | 1.4 parts |
| Bisphenol A type epoxy acrylate (NK Oligomer EA-1020, Shin-Nakamura Chemical Co., Ltd.) | 1.4 parts |
| Pentadecafunctional urethane acrylate (NK Ester U-15HA, Shin-Nakamura Chemical Co., Ltd.) | 1.4 parts |
| Polymer acrylate (solid content: 50%) (NK Ester C-24T, Shin-Nakamura Chemical Co., Ltd.) | 0.7 parts |
| Filler (silica) (average particle size: 12 nm) (solid content: 50%) (MEK-AC2140Z, Nissan Chemical Corp.) | 5.9 parts |
| Photo-polymerization initiator (Irgacure(R) 184, BASF Japan Ltd.) | 0.14 parts |
| Surface conditioning agent (solid content: 50%) (LF1984, Kusumoto Chemicals, Ltd.) | 0.14 parts |
| Toluene | 4.8 parts |
| Methyl ethyl ketone | 9.5 parts |

(Preparation of Transfer Receiving Article)

A card substrate having the composition described below was prepared.

<Preparation of Card Substrate>

| | |
|---|---|
| Polyvinyl chloride compound (degree of polymerization: 800) (containing 10% of additives such as a stabilizer) | 100 parts |
| White pigment (titanium oxide) | 10 parts |
| Plasticizer (dioctyl phthalate) | 0.5 parts |

(Formation of Image)

A 128/256 gray scale image was formed on the receiving layer of each intermediate transfer medium (intermediate transfer media 1 to 3) prepared as described above using HDP5000 (HID Global Corp.) printer and a thermal transfer ribbon dedicated to the printer. The size of the image formation region was 88 mm×56 mm.

(Transfer of Inhibit Layer)

Each intermediate transfer medium with the gray image formed thereon was combined with the thermal transfer sheet of each of Examples and Comparative Examples. The inhibit layer was transferred with a size of 20 mm square (20 mm×20 mm size) onto the central part of the gray image using the HDP5000 (HID Global Corp.) printer. The transfer of the inhibit layer was performed by the standard settings of the printer.

As for the thermal transfer sheets of Examples 2, 3, 6, 7, 9, 10, 12, and 13, and Comparative Examples 3 and 4, 5, the heat-seal layer was selectively transferred onto the inhibit layer transfer receiving region of the gray image using the HDP5000 (HID Global Corp.) printer. The transfer of the heat-seal layer was performed by the standard settings of the printer.

(Transfer of Transfer Layer)

Each intermediate transfer medium with the inhibit layer transferred thereon was combined with the transfer receiving article prepared as described above. Energy was applied to the whole region having an overlap with the gray image on the intermediate transfer medium using the HDP5000 (HID Global Corp.) printer. The transfer layer of each intermediate transfer medium to which energy had been applied was transferred onto the transfer receiving article to obtain a print of each of Examples and Comparative Examples. The transfer of the transfer layer was performed by the standard settings of the printer.

(Tailing Evaluation)

The length of tailing in the print of each of Examples and Comparative Examples obtained as described above was measured, and the tailing was evaluated on the basis of evaluation criteria given below. The evaluation results are shown in Table 1.

"Evaluation Criteria"

A: the length of the tailing was 1 mm or smaller.

B: the length of the tailing was larger than 1 mm and 3 mm or smaller.

NG(1): the length of the tailing was larger than 3 mm and 5 mm or smaller.

NG(2): the length of the tailing was larger than 5 mm.

(Evaluation of Lack of Transfer (Transferability Evaluation))

In the print of each of Examples and Comparative Examples, the length of a region with a lack of transfer of the transfer layer in the flow direction of printing originating from the outer edge of the inhibit layer was measured, and the lack of transfer was evaluated on the basis of evaluation criteria given below. The evaluation results are shown in Table 1.

"Evaluation Criteria"

A: the length of the region with a lack of transfer was 0.3 mm or smaller.

B: the length of the region with a lack of transfer was larger than 0.3 mm and 1 mm or smaller.

C: the length of the region with a lack of transfer was larger than 1 mm and 3 mm or smaller.

NG: the length of the region with a lack of transfer was larger than 3 mm.

(Appearance Evaluation)

In the print of each of Examples and Comparative Examples obtained as described above, the surface of the transfer receiving article was rubbed in one round trip while a nail was put on the surface of the transfer receiving article in a region brought into contact with the inhibit layer, i.e., the surface-exposed region. Then, the surface state of the transfer receiving article was visually observed, and the appearance was evaluated on the basis of evaluation criteria given below. The evaluation results are shown in Table 1.

"Evaluation Criteria"

A: no scratch mark remained on the surface of the transfer receiving article.

B: a scratch mark remained on the surface of the transfer receiving article.

TABLE 1

| | Summary of thermal transfer sheet | | Category of intermediate transfer medium | | | | | | | | |
|---|---|---|---|---|---|---|---|---|---|---|---|
| | | | Intermediate transfer medium 1 | | | Intermediate transfer medium 2 | | | Intermediate transfer medium 3 | | |
| | Type of coating liquid for inhibit layer | Type of coating liquid for heat-seal layer | Tailing | Lack of transfer | Appearance | Tailing | Lack of transfer | Appearance | Tailing | Lack of transfer | Appearance |
| Example 1 | Coating liquid for inhibit layer 1 | None | A | B | B | A | B | B | A | C | B |
| Example 2 | Coating liquid for inhibit layer 1 | Coating liquid for heat-seal layer 1 | A | A | B | A | A | B | B | B | B |
| Example 3 | Coating liquid for inhibit layer 1 | Coating liquid for heat-seal layer 2 | A | A | B | A | A | B | B | B | B |
| Example 4 | Coating liquid for inhibit layer 2 | None | A | B | B | A | B | B | A | C | B |
| Example 5 | Coating liquid for inhibit layer 3 | None | A | B | A | A | B | A | A | C | A |
| Example 6 | Coating liquid for inhibit layer 3 | Coating liquid for heat-seal layer 1 | A | A | A | A | A | A | B | B | A |
| Example 7 | Coating liquid for inhibit layer 3 | Coating liquid for heat-seal layer 2 | A | A | A | A | A | A | B | B | A |
| Example 8 | Coating liquid for inhibit layer 4 | None | A | B | A | A | B | A | A | C | A |
| Example 9 | Coating liquid for inhibit layer 4 | Coating liquid for heat-seal layer 1 | A | A | A | A | A | A | B | B | A |
| Example 10 | Coating liquid for inhibit layer 4 | Coating liquid for heat-seal layer 2 | A | A | A | A | A | A | B | B | A |
| Example 11 | Coating liquid for inhibit layer 5 | None | A | B | A | A | B | A | A | C | A |
| Example 12 | Coating liquid for inhibit laver 5 | Coating liquid for heat-seal layer 1 | A | A | A | A | A | A | B | B | A |
| Example 13 | Coating liquid for inhibit layer 5 | Coating liquid for heat-seal layer 2 | A | A | A | A | A | A | B | B | A |
| Comparative Example 1 | Coating liquid for inhibit layer A | None | NG (1) | B | — | NG (1) | B | — | NO (2) | B | — |
| Comparative Example 2 | Coating liquid for inhibit layer B | None | NG (1) | B | — | NG (1) | B | — | NO (2) | B | — |
| Comparative Example 3 | Coating liquid for inhibit layer A | Coating liquid for heat-seal layer 1 | NG (1) | B | — | NG (1) | B | — | NO (2) | B | — |

TABLE 1-continued

| | Summary of thermal transfer sheet | | Category of intermediate transfer medium | | | | | | | | |
|---|---|---|---|---|---|---|---|---|---|---|---|
| | | | Intermediate transfer medium 1 | | | Intermediate transfer medium 2 | | | Intermediate transfer medium 3 | | |
| | Type of coating liquid for inhibit layer | Type of coating liquid for heat-seal layer | Tailing | Lack of transfer | Appearance | Tailing | Lack of transfer | Appearance | Tailing | Lack of transfer | Appearance |
| Comparative Example 4 | Coaling liquid for inhibit layer B | Coating liquid for heat-seal layer 2 | NG (1) | B | — | NG (1) | B | — | NO (2) | B | — |

REFERENCE SIGNS LIST

1 . . . substrate
2 . . . inhibit layer
3 . . . adhesive layer
7 . . . dye layer
8 . . . heat-seal layer
10 . . . thermal transfer sheet
31 . . . support
32 . . . release layer
35 . . . receiving layer
36 . . . protective layer
40 . . . transfer layer
50 . . . intermediate transfer medium
60 . . . transfer receiving article
70 . . . thermal transfer image
100 . . . print
A . . . peripheral edges of transfer layer
B . . . region allocated for IC chip

The invention claimed is:

1. A combination of a thermal transfer sheet and an intermediate transfer medium,
wherein the thermal transfer sheet comprises an inhibit layer disposed on a substrate so as to be peelable from the substrate,
wherein the inhibit layer can be transferred onto the intermediate transfer medium,
wherein the inhibit layer contains at least one member selected from the group consisting of a cured product of an active ray-curable resin, a cured product of a silicone resin, and a cured product of a thermoplastic resin,
wherein the intermediate transfer medium comprises a transfer layer disposed on a support,
wherein a release layer is disposed between the support and the transfer layer, and
wherein the release layer contains silsesquioxane.

2. A combination of a thermal transfer sheet and an intermediate transfer medium,
wherein the thermal transfer sheet comprises an inhibit layer disposed on a substrate so as to be peelable from the substrate,
wherein the inhibit layer can be transferred onto the intermediate transfer medium,
wherein the inhibit layer contains a carnauba wax,
wherein the intermediate transfer medium is an intermediate transfer medium in which a transfer layer is disposed on a support, the transfer layer having a single-layer configuration consisting of a receiving layer, or having a layered configuration where a receiving layer is positioned furthest from the support,
wherein a release layer is disposed between the support and the transfer layer,
wherein the release layer contains silsesquioxane,
wherein the release layer further contains urethane-modified polyester having a glass transition temperature (Tg) of 50° C. or lower, and
wherein the inhibit layer further contains a polyethylene wax and a thermoplastic elastomer.

3. A combination of a thermal transfer sheet and an intermediate transfer medium,
wherein the thermal transfer sheet comprises an inhibit layer disposed on a substrate so as to be peelable from the substrate,
wherein the inhibit layer can be transferred onto the intermediate transfer medium,
wherein the inhibit layer contains a carnauba wax,
wherein the intermediate transfer medium comprises a transfer layer is-disposed on a support, the transfer layer having a single-layer configuration consisting of a receiving layer, or having a layered configuration where a receiving layer is positioned furthest from the support,
wherein a release layer is disposed between the support and the transfer layer, and
wherein the release layer contains silsesquioxane.

4. The combination of a thermal transfer sheet and an intermediate transfer medium according to claim 3, wherein at least one of a dye layer and a heat-seal layer, and the inhibit layer are sequentially disposed on a surface of the substrate.

5. The combination of a thermal transfer sheet and an intermediate transfer medium according to claim 4, wherein the dye layer, the inhibit layer, and the heat-seal layer are sequentially disposed on the surface of the substrate.

6. The combination of a thermal transfer sheet and an intermediate transfer medium according to claim 4, wherein the dye layer, the heat-seal layer, and the inhibit layer are sequentially disposed on the surface of the substrate.

7. The combination of a thermal transfer sheet and an intermediate transfer medium according to claim 3, wherein the transfer layer comprises a layered structure where a protective layer and the receiving layer are layered in the presented order from the support side, and
wherein the protective layer contains a cured product of an active ray-curable resin.

8. A method for producing a print using a combination of a thermal transfer sheet and an intermediate transfer medium according to claim 3,
the method comprising:
the step of forming a thermal transfer image on the transfer layer of the intermediate transfer medium;
a first transfer step of transferring the inhibit layer of the thermal transfer sheet onto a part of the transfer layer with the thermal transfer image formed thereon; and
a second transfer step of transferring the transfer layer of the intermediate transfer medium onto a transfer receiving article, wherein the second transfer step is the step of using the inhibit layer transferred onto a part of the transfer layer as a masking member, and transferring the transfer layer having no overlap with the inhibit layer onto the transfer receiving article.

* * * * *